US011533954B2

(12) United States Patent
Azan et al.

(10) Patent No.: US 11,533,954 B2
(45) Date of Patent: Dec. 27, 2022

(54) STRETCHABLE WOMEN'S GARMENT

(71) Applicants: Annette Azan, Brooklyn, NY (US); Elizabeth R. Zuber-Sherr, Sea Cliff, NY (US); Michaela Zuber, Sea Cliff, NY (US)

(72) Inventors: Annette Azan, Brooklyn, NY (US); Elizabeth R. Zuber-Sherr, Sea Cliff, NY (US); Michaela Zuber, Sea Cliff, NY (US)

(73) Assignee: Nuu Collective LLC, Sea Cliff, NY (US)

( * ) Notice: Subject to any disclaimer, the term of this patent is extended or adjusted under 35 U.S.C. 154(b) by 101 days.

(21) Appl. No.: 17/099,222

(22) Filed: Nov. 16, 2020

(65) Prior Publication Data

US 2021/0120889 A1 Apr. 29, 2021

Related U.S. Application Data

(63) Continuation of application No. 16/155,459, filed on Oct. 9, 2018, now Pat. No. 10,834,976, which is a continuation-in-part of application No. 15/827,884, filed on Nov. 30, 2017, now Pat. No. 10,285,454, which is a continuation of application No. 14/813,446, filed on Jul. 30, 2015, now Pat. No. 9,848,658.

(51) Int. Cl.
*A41C 3/00* (2006.01)
*A41F 15/00* (2006.01)

(52) U.S. Cl.
CPC ..... *A41C 3/0021* (2013.01); *A41F 15/00* (2013.01)

(58) Field of Classification Search
CPC ... A41C 3/0021; A41C 3/0028; A41C 3/0078; A41F 15/00; A41F 15/02
USPC ..... 450/70
See application file for complete search history.

(56) References Cited

U.S. PATENT DOCUMENTS

2006/0048547 A1* 3/2006 Duckham ..... A41C 3/0014 66/176
2009/0126084 A1* 5/2009 Fenske ..... A61F 5/026 2/243.1

* cited by examiner

*Primary Examiner* — Timothy K Trieu
(74) *Attorney, Agent, or Firm* — Pryor Cashman LLP

(57) ABSTRACT

A bra or a garment, and an associated method of construction, where the bra or garment includes a first front panel configured to support a user's breast, a first pair of straps integrally formed and extending from the first front panel, the first front panel and first pair of straps formed from a unitary tube of an elastomeric or mechanical stretch material, where the first front panel is capable of stretching to an extended position when the bra or garment is worn by the user.

20 Claims, 14 Drawing Sheets

STRETCHABLE WOMEN'S GARMENT

RELATED APPLICATIONS

This application is a continuation application of U.S. patent application Ser. No. 16/155,459, filed Oct. 9, 2018, now U.S. Pat. No. 10,834,976, issued Nov. 17, 2020, which is a continuation-in-part application of U.S. patent application Ser. No. 15/827,884, filed Nov. 30, 2017, now U.S. Pat. No. 10,285,454, issued May 14, 2019, which is a continuation application of U.S. patent application Ser. No. 14/813,446, filed Jul. 30, 2015, now U.S. Pat. No. 9,848,658, issued Dec. 26, 2017, the disclosures and teachings of which are all incorporated herein by reference.

FIELD OF THE INVENTION

The present invention relates to a soft, very lightweight, flexible, washable and alternatively disposable, woman's bra which is preferably made of knitted tubes or cylinders of knit nylon or similar elastic material formed via conventional machines used for knitting tubular fabrics, much like those now in use in making women's hosiery. The bra provides frontal support for a wearer's breasts in a sling like fashion by extending beneath and supporting the breasts and tethers or supports the weight, in the currently preferred embodiment, substantially behind the neck of the wearer. The device is somewhat "invisible" in that as a consequence of being made of thin, nylon material, it can be substantially clear, nude, ecru, skin tone or "see through" and the body's color is seen therethrough. In the preferred and disclosed embodiment, a strap-like element or set of straps extend upwardly from the two sides of the cups or extend as part of one unbroken woven tube or pair of elastic nylon tubes to meet behind the neck. Each rear strap length extends from a side extending panel wrapping slightly around the side of each breast. In the halter version of the invention, a second set of straps extends upwardly along the center of the wearer's chest and also secures behind the wearer's neck. A pair of front panels or breast supports, formed of the tubular elastic nylon knit material, cover the breasts and the slight side extensions offers additional support structure for an even lifting, holding and support.

A pair of circular nylon tubes are formed, folded flat and sewn to form opposed breast cup panels or slings for supporting the breasts from beneath. As the breasts are placed into the cup panels, the elastic, knit nylon material supports the weight of the breasts in a sling-like manner. Just below the breasts, under the weight of the breasts, the knit cylindrical but flattened nylon tubes turn relatively rigid and serve as an underwire-like support—but without the wire. The breasts are naturally held but supported from below by the rigid and strong nylon tubings, under stress of the load of the breasts. And, the wearer can adjust the position of her breasts and they will be held in place, whether she is trying to accentuate her cleavage, defocus the same, etc. hold them high, low, with separation or close together. The tubular nylon-like and elastic fabric components, preferably made of elastic nylon knit material, are lightweight. Because of the stretch yet soft properties of the nylon knit tubes, when the breasts are in the cup panels or sling of the bra, their weight creates a rigidity to the knit nylon material that causes it to act like an underwire support system, but without the metallic wiring.

In the preferred embodiment, the slings laterally and rearwardly extend (along the woman's side) and then upwardly to create a pair of rear straps which, in the case of the halter style of the invention, meet behind the neck of the wearer. In this manner, the bra is like a halter top. The breast covering panels also extend upwardly in the central front of the wearer and then narrow to a second set of straps which also extend behind the neck. The front pair of straps and the rearward pair of straps hold behind the wearer's neck and support the breasts, too, along with the sling of the bra formed of the stressed, below the breasts, bra of tubular nylon fabric. However, the sling supports can extend behind the wearer, like the bra strap of a conventional bra, and be with or without shoulder straps, too. The set of straps for the halter version extend upwardly from the cup panels and meet one another behind the neck or can be a part of one unbroken woven tube to meet behind the neck. Each narrow rear strap extends from a small side-extending panel of the breast-covering panel and wraps slightly around each breast. A pair of opposed front panels, formed of the tubular nylon material, cover the breasts, and the slings formed of the nylon material, are below the breasts and hold and support the breasts as that material, when subjected to the weight of the breasts, becomes somewhat rigid and strong. Also, by use of the elastic tubular nylon knit material, as set forth herein, a bra is provided which can accommodate various sizes, roundness, and geometries of breasts.

The slight side extension or side panel, also of elastic, tubular knitted and sewn nylon material, offers additional support and structure for lifting, holding and support of the sides of the breasts. Preferably, the side panels narrow as they extend upwardly towards the rear and form one or more holding straps with an elastic neck piece (in the preferred embodiment extending to behind the neck as a halter bra). In the halter bra configuration, a waist encircling band is also provided, extending just below the breasts and around to the back of the wearer, to hold the bra in position. It is also within the contemplation of the inventor that the two pairs of upwardly extending halter-like and behind the neck straps can be replaced by continuous or unbroken straps or that the straps for a halter bra be replaced with a behind the back strap and shoulder supporting straps (as is currently conventional). Also, the pairs of straps can take the form of an unbroken nylon tubular piece extending from the front of a first cup of the bra, behind the neck, and down to the other opposed cup of the bra. Similarly, in an unbroken manner, the rear strap from one side panel can narrow and extend behind the neck of the wearer and continue on as the rear strap of the other or opposed side panel. The connected together straps, through an intermediate elastic neck piece, or the integrated with one another strap (i.e., a continuous strap segment) vertically extend to behind the neck to hold the bra in place.

In the halter style, the bra also may include a body encircling band, just below the breasts, which surrounds a portion of the wearer's rib cage and extends around the lower or middle back of the wearer. That band can be vertically adjustable and helps to secure the bra to the wearer's body and may include a silicone lining to enhance the functional holding of the bra in place. Because the bra is made of knitted tubular nylon pieces (flattened and sewn) or other circular woven elastic-like fabric, the wearer benefits from the comfortable support provided by a light weight, breathable, movable, easy to wash, substantially transparent, and hardware-less bra, which many wearers will find quite natural and "free" and therefore to be an improvement on the bra options currently available. The bra can be sold in a limited number of sizes (as the nylon tubing accommodates and supports a variety of sizes and shapes of breasts) and, yet, as a consequence of the material and its elasticity and the manner by which the sling supports the breasts, the bra will be suitable and comfortable, and provide support for a variety of breast shapes, sizes, and configurations.

The breast supporting bra provides a light weight, non-metallic (no underwire is required) support system which easily distributes and bears the weight of the breasts by the elastic nylon tubes becoming rigid and acting as a supporting sling below the weight of the supported breasts, i.e., directly beneath the same and around to the sides, while maintaining the attractive appearance and location of the breasts, in a substantially natural manner and without discomfort. The sling formed of the nylon tubes, extending below and to the side of the breasts becomes relatively rigid when stressed from above by the weight of the breasts and transfers the "weight" of the breasts so they are firmly supported by the bra, with the weight comfortably held by the now-rigid nylon material below the breasts and to the side (under the stress and weight of the breasts) and, in the case of the halter version of the bra, with the weight also borne by the wearer's neck, rather than the load bearing down on the woman's shoulders. The bra provides a new article of wearing apparel, fully functional, and allows the breasts to retain their natural shape and positioning.

The bra is quite simple to put on and take off. The halter version of the bra also allows for a backless visual look and effect as the present invention does not necessarily include unseemly shoulder straps. Since the breasts are supported from below by the stressed tubular knit nylon forming a sling for the breasts, a new and inventive bra is provided. In the halter version of the present invention, the slings for the breasts with the central covering panels extending upwardly, forwardly and rearwardly yet along the sides, form a new and fully functional bra. This embodiment of the bra is visually ideal for backless dresses and, in any event, the support of the breasts by the slings (made more rigid by the weight of the breasts on the circular tubes of elastic nylon) and held behind the rear of the neck is believed more or at least as comfortable as the conventional shoulder support for the weight of the breasts as provided by today's prior art bras. In the present halter version of the invention, only the strap sets around to the back of the neck and the slight, narrow, lower and body encircling band extending near the bottom of the ribs and extending around to the back of the wearer, can be seen. Substantially the entire bra is made of a soft elastic, tubular knit nylon material. It is breathable, comfortable, lightweight and provides a bra without the need for metal underwire. All components and elements cooperate together to provide for comfortable and efficient support. Only the neck and the rear of the lower waist strap are visible from behind (in this halter version), leaving the entire upper back beautifully bare. The present invention is therefore ideal for backless women's fashions which have become popular with many women as the new bra will create no unsightly or suggestive bra straps.

BACKGROUND OF THE INVENTION

Women have worn bra-like undergarments to support breasts for decades (if not centuries). Today's bras are typically two soft but inelastic soft fabric or foam cups pre-formed in a concave shape to accept, protect and support the breasts and often underlined with metal wire to maintain shape and support. The cups are held in place with a waist or chest encircling thick strap around the rib cage which closes around the back of the wearer using metal hooks and eye mechanisms and adjustable shoulder straps that are attached to the cups and to the rear of the waist strap, usually with metal rings. Front opening/closing bras are also within the prior art. The shoulder straps are generally adjustable to accommodate various geometries of breasts, high breasts, low, close together, spread apart, etc. The waist strap usually joins in the back. These bras are uncomfortable for many women. For one, the metal underwire or rigid bone-like stiff pieces are rigid and while encased in soft fabric material, still bear against the body. They are heavy because of the weight, albeit slight, of the underwire and supports. The weight of the bra and the supported breasts are often supported by the shoulders and thus the weight bears down on the wearer's shoulders and that, too, can be uncomfortable. Also, the individual components stretch over time as well, changing the fit of the bra with each wear. Also, as a consequence of many different sizes of women's breasts and shapes, a wide variety of bras need to be in store or inventory for a retailer to offer the same for sale. Further, while the traditional bra often cannot be seen under the usual blouse or tee shirt, it is common for an ill-fitting bra to be obvious to onlookers. It is also common for women to wear shirts or dresses of many styles and cuts through which the bra, with rear large horizontal strap and shoulder strap(s) would be clearly visible. It is thus advantageous to provide a bra that is comfortable, lightweight, fully supportive of the breasts, holds them naturally and not necessarily by the shoulders and allows the breasts to have their normal separation, and which will not be visible under a wide variety of clothing styles. Several such bras have been developed, including strapless bras, stick on bra cups, and soft material bras yet none provide both comfort, lightweight, and full breast support at the same time nor with the weight moved from the shoulders to a supporting sling below the breasts.

The present invention provides a new bra which supports the breasts by a sling-like mechanism as a consequence of the nylon tubes, when stressed under the weight of the breasts, becoming rigid and supportive of the above-located breasts. The new bra supports the breasts from below. The elastic, tubular nylon knit material of the front cup panels becomes quite rigid under the weight of the breasts and the nylon thus supports the same, removing much of the load from the shoulders and the back. Also, a halter version can be provided which is somewhat backless, strapless, metalless, soft, comfortable, yet a supportive bra that can be basically invisibly worn (from a rear view) under a wide variety of dress and shirt styles while creating, supporting and maintaining substantially natural breasts. The present invention generally comprises a pair of cup panels for the breasts made of knit, elastic nylon tubes, folded and sewn to provide a light and simple cover to the breasts but a fully under breast support, without wiring. The elastic, knit nylon tubes, when subjected to the stress and weight of the breasts, becomes rigid and supports the breasts. Yet, the unstressed portion of the cup panels, not bearing the weight of the breasts, is flimsy, light, substantially see through and serves only as a thin covering for the center of the breasts. The breasts are supported from below. This new bra fully accommodates different size, shapes, weighted breasts in a natural and elegant manner.

SUMMARY OF THE INVENTION

The present invention is formed of elastic nylon, in one or more circular, machine knitted tubes. The preferred and disclosed herein embodiment is a halter-like (suspended about the neck of the wearer) bra that provides an inexpensive, breathable fabric, easy to don and remove, and results in a comfortable breast support system like a sling while minimizing the bra's visibility under clothing, particularly under revealing clothing under which traditional bras are glaringly obvious. The bra can be made in a traditional style, too, with a rear set of straps and a pair of shoulder straps. The key, however, is that the nylon tubular and then flattened and sewn breast cup panels when stressed or weighted by the breasts, will become somewhat rigid, and support, from below, the breasts, like a sling or hammock, while the non-weighted portions of the cup panels (the front of the breasts) are still flimsy, lightweight, and sheer. The stressed elastic tubular nylon under the weight of the nylon tubing serves as a supporting sling for the breasts and the amount of rigidity provided by the underneath stressed nylon tubes is proportional to the weight or size of the breasts so that the larger the breasts in weight the more the nylon tubes are stressed and the more rigid the slings become for required under-breast support. Of course, the reverse is true, too. The smaller the breasts, the less the nylon tubing is stressed and the less the below the breasts portions of the bra are made rigid as the sling for support of the bra is not as important to the support of the breasts.

The preferred style of the invention, a halter bra, also comprises a waist band, preferably of an elastic, flexible and soft yet supportive nylon material, which encircles a wearer's rib cage just below the breasts and extends around the back but is easily adjustable to fall or lay across a preferred position on the wearer's back and preferably includes a silicone lining to frictionally yet comfortably hold the band in place against the wearer's skin.

The bra preferably includes two tubular fabric cup panels or sections, made of the machine knitted, tubular nylon material, for holding and supporting each breast, each cup made of a nylon knitted cylindrical and flattened tube, the tube being formed from a small section of nylon knitted fabric, like hosiery, yet folded flat (made two ply) to provide dual layers of elastic support. The nylon tubes are formed into breast holding front or cup panels. A lower horizontal edge of the panels (each L-shaped) is joined to the encircling waist band (in this style) and the elastic, nylon knit cup panels then extend upwardly in the front to form a single strap or a pair of mating straps which secure behind the wearer's neck. In addition, the cup panels extend sidewise about the breasts and then upwardly into a second pair of narrow straps. These, too, extend upwardly and either are integrated or uninterrupted into a continuous tubular piece held behind the wearer's neck or are sewn to the sides of a mating elastic neck piece which is held behind the wearer's neck. In one embodiment the four straps (two in the central front and two extending from the side panel of the cup panels—in the halter style) can be secured to a single elastic neck piece which is adjustable for size. In another embodiment, each pair of straps are continuous or endless, i.e., mere continuations of one another, i.e., without a means for clasping nor separating. Rather, they merely extend as a single continuous strip or strap to behind the wearer's neck from cup to cup. Each cup panel is secured to the waist band and each cup panel and its connected pair of straps are joined together by conventional seaming, stitching or other similar mechanical or fabric securing mechanisms all to produce a woman's bra held in a halter like manner with the major support being provided by the stressed elastic, tubular knit fabric beneath the breasts (and extending slightly to and on the sides) in a sling manner, a function of the weight of the breasts making the otherwise soft and flexible nylon tubes into rigid, supporting nylon material beneath the breasts.

Another supporting component of the halter style of the invention has the side panels narrowing into vertical straps which extend up and around the wearer's neck. The front and central part of the panel cups can also form narrow straps and can either join behind the wearer's neck to an elastic neck piece or be a single continuous strap from one cup panel to the other (but behind the wearer's neck). The cup panels, straps, and side panel pieces can be manufactured as a single or a few pieces of elastic, tubular, knit nylon flattened, cut and then seamed together to produce the bra. When worn, the breasts are thus naturally separated and supported in a sling like manner as the knitted nylon tubing provides support from underneath the breasts. This is a consequence of the elastic tubular knit nylon fabric becoming rigid when stressed by the weight of the breasts. The inner layer of the cup panels i.e., the layer of fabric directly covering and also holding the breasts, is maintained sheer, flexible, and substantially transparent as those sections are not under stress. But the underneath portions, stressed by the weight of the breasts, serves as a more rigid and supporting sling and secures the breast in a natural and comfortable shape. Portions of the nylon and circular tubing, when stressed by heavy breast material, become taut as a feature of the elastic nylon fabric and provide support. The side panel portion, as the lower portion of the cup panels, will, when in contact with the weight of the breasts, become taut and rigid when the bra is on the wearer and therefore offer additional structure at the edges of the breasts to keep the breasts in a forward, separated, natural orientation and position. Stated differently, the top and the inside layers of the tubular knitted elastic nylon material work independently and cooperatively to support, maintain and provide a natural feeling, look, freedom and supporting bra for the breasts of the woman.

These features of the invention create a comfortable, movable, and breathable bra that supports the breasts in a sling like manner (i.e., from beneath) that holds them in their natural and visually pleasing shape. In the halter version, the straps of the bra are not visible under backless or sleeveless clothing as the straps are held behind the neck with only a small and thin strap, below the breasts, not aligned with the breasts as in conventional bras, extending around the back of the wearer. The new bra is highly adaptive to women with different breast sizes and shapes as the tubular nylon knit material is elastic and stretches to accommodate the same and, yet, when stressed by the weight of the breasts from above, the panels become rigid and provide excellent support to the overlying breasts. Yet, the non-stressed parts of the cup panels are still sheer, lightweight, and allow the location and orientation, as desired, of the breasts.

In general, in one aspect, the invention features a bra including a first front panel configured to support a user's breast, a first pair of straps integrally formed and extending from the first front panel, the first front panel and first pair of straps formed from a unitary tube of an elastomeric or mechanical stretch material, and a band configured to encircle the user's abdomen and to which the first front panel and first pair of straps are affixed, where the first front panel is capable of stretching to an extended position when the bra is worn by the user.

Implementations of the invention may include one or more of the following features. The bra may further include a second front panel configured to support a user's breast, and a second pair of straps integrally formed and extending from the second front panel, the second front panel and second pair of straps formed from a second unitary tube of an elastomeric or mechanical stretch material and are affixed to the band, where the second front panel is capable of stretching to an extended position when the bra is worn by the user. The elastomeric or mechanical stretch material may be knitted, woven, or non-woven. The elastomeric or mechanical stretch material may include nylon and an elastomer or a mechanical stretch fabric. The first panel and the first pair of straps may have a double-layer structure. The first panel and the first pair of straps may have flat folded seamless edges. The bra may further include stitching at a central portion of the first panel and/or the first pair of straps. The first pair of straps and the second pair of straps may be attached at different positions on the band. The band may be formed from a tube-shaped, elastomeric or mechanical stretch material, and the band may be formed from the same elastomeric or mechanical stretch material as the first panel and the first pair of straps. The bra may further include a ring disposed around the first pair of straps. The bra may further include a support material sewn or integrated into the first pair of straps, and the support material may be a stretchable tape, a stabilizer, a fabric through a yarn, or a tensioning element.

In general, in another aspect, the invention features a garment including a first front panel configured to support a user's breast, and a first pair of straps integrally formed and extending from the first front panel, the first front panel and first pair of straps formed from a unitary tube of an elastomeric or mechanical stretch material, where the first front panel is capable of stretching to an extended position when the garment is worn by the user.

Implementations of the invention may include one or more of the following features. The garment may further include a second front panel configured to support a user's breast, and a second pair of straps integrally formed and extending from the second front panel, the second front panel and second pair of straps formed from a second unitary tube of an elastomeric or mechanical stretch material, where the second front panel is capable of stretching to an extended position when the garment is worn by the user. The elastomeric or mechanical stretch material may be knitted, woven, or non-woven. The elastomeric or mechanical stretch material may include nylon and an elastomer or a mechanical stretch fabric. The first panel and the first pair of straps may have a double-layer structure. The first panel and the first pair of straps may have flat folded seamless edges. The garment may further include stitching at a central portion of the first panel and/or the first pair of straps. The garment may further include a support material sewn or integrated into the first pair of straps.

In general, in another aspect, the invention features a method of constructing a bra including forming a first front panel configured to support a user's breast and a first pair of straps integrally formed and extending from the first front panel from a unitary tube of an elastomeric or mechanical stretch material, and affixing the first front panel and the first pair of straps to a band configured to encircle the user's abdomen, where the first front panel is capable of stretching to an extended position when the bra is worn by the user.

BRIEF DESCRIPTION OF THE DRAWINGS

FIG. 4A shows the inside of the bra while

DETAILED DESCRIPTION OF THE INVENTION, THE DRAWINGS, AND THE PREFERRED EMBODIMENT

Figure 1:
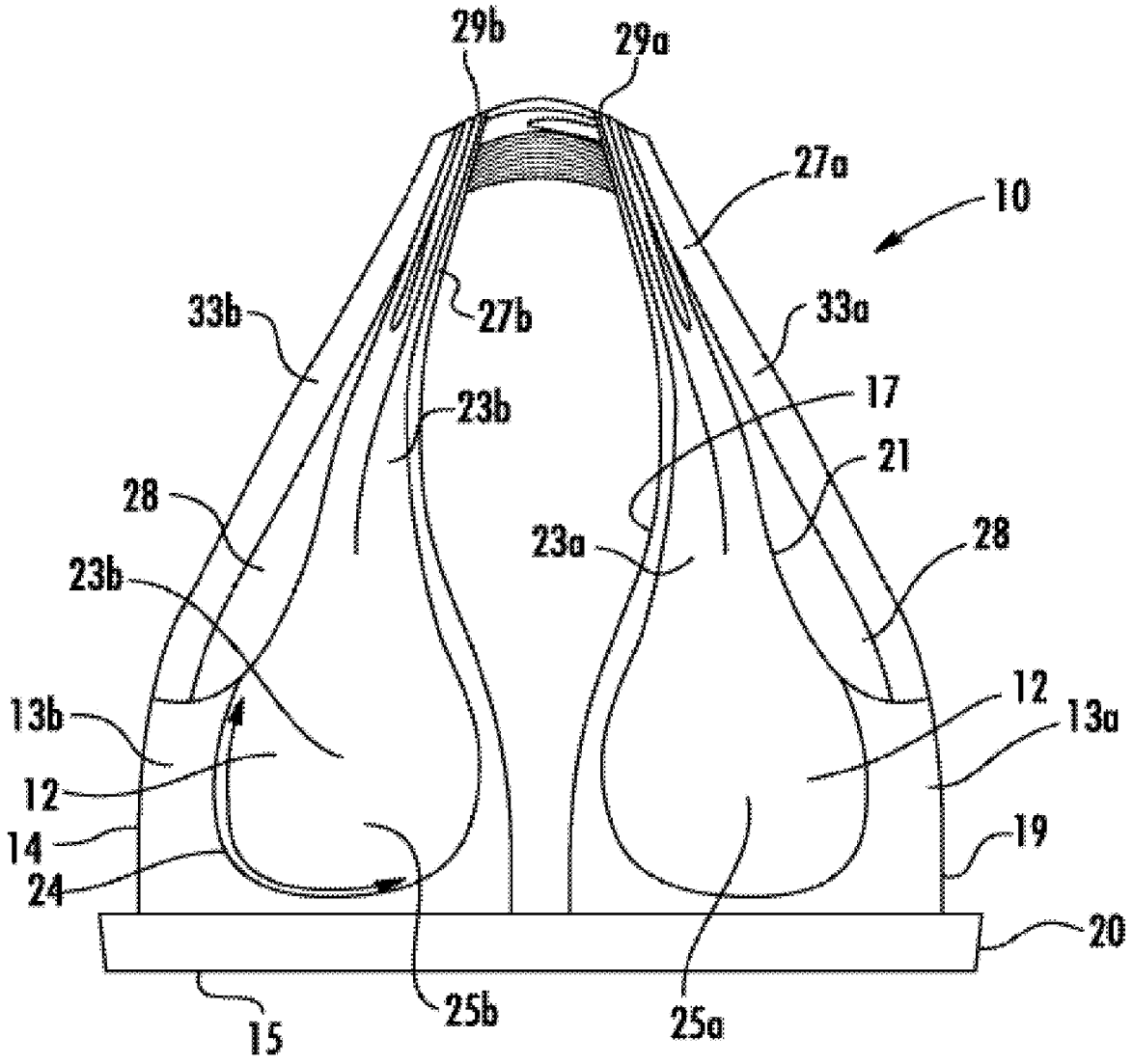
FIG. 1 is a frontal view of a halter and first embodiment of the bra as described herein as would be seen from the front and as worn on a woman/wearer. The "release" portion of the bra, i.e., where the breasts would be centrally held, as depicted, is nylon tubular knit fabric which is more fully maintained or expanded than the other, supporting portions of the same nylon tubular knit fabric so, for drawing purposes, the central or fully expanded or non-taut areas are shown as "white" and the other stressed and sling or support sections shown as textured fabric, below the breasts. It should be appreciated, however, that the entire front of the bra shown herein is formed of two opposing cup panels each extending, laterally, from the inside or cleavage edge (described below) to the front of the side opening edges and through and to the side panels and side edges. The two pairs of halter straps, extending to behind the wearer's neck is shown as is a waist encircling elastic band.
Figure 2:
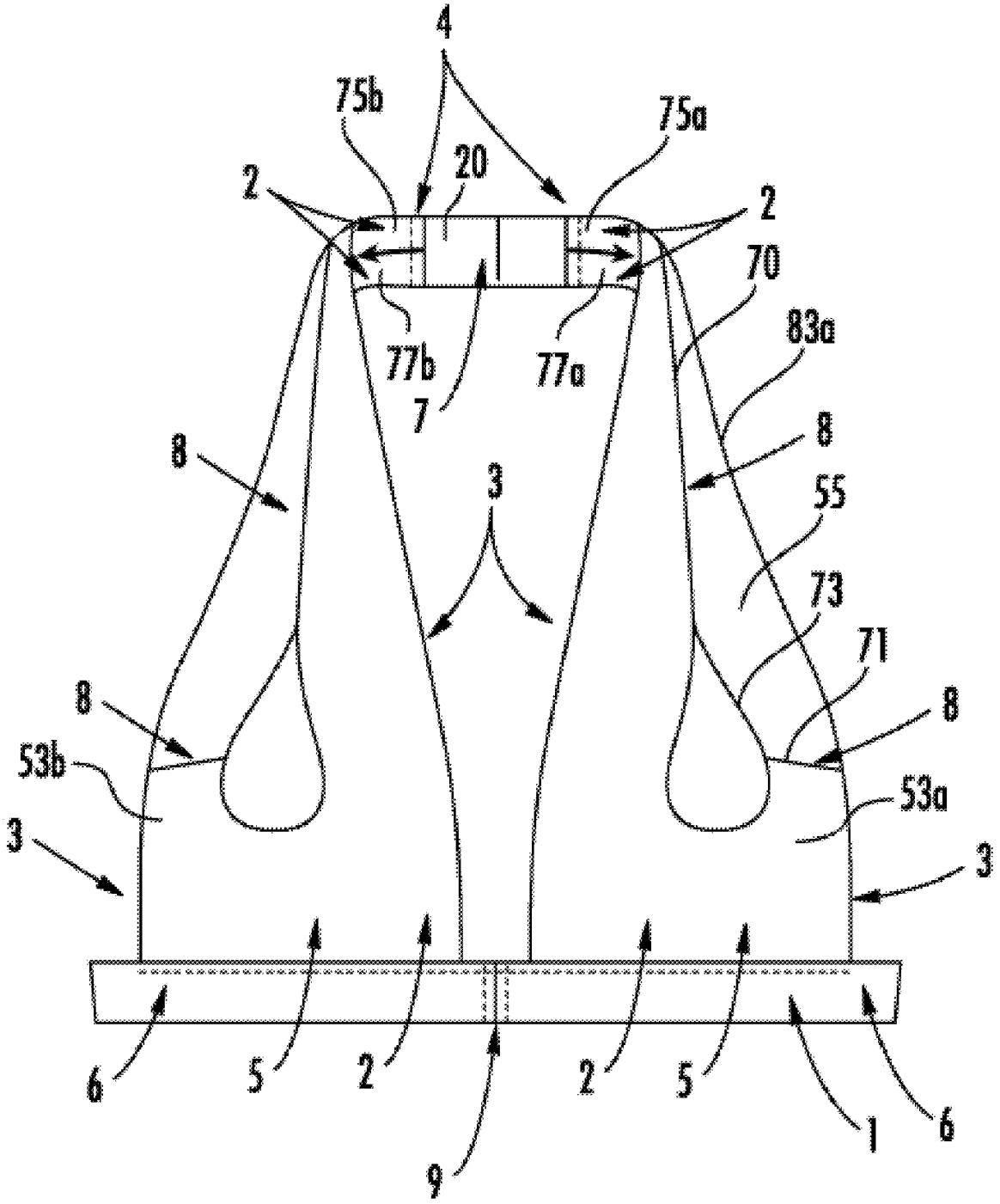
FIG. 2 is the currently preferred embodiment of the halter style of the bra, showing its front view similar to that of FIG. 1. The teardrop shape in the central front is not an opening of the fabric but, rather, shows the release portion of the tubular knit nylon fabric as fully expanded and the below and side portions of the bra, stressed by the weight and size of the supported breasts being shown as more solid fabric components. It will be appreciated that the entire front cup panels are made of the tubular nylon and elastic material, even that shown as "white" in the black and white drawings. Again, the entire front or the cup panels, extending from inside cleavage edge to the outside of the cup panels, is formed of the tubular, knit, nylon and elastic fabric with no holes nor openings, only seaming of the tubular piece to itself, for each cup panel.

The invention is a lightweight, thin material, and preferably easily washable (yet may be disposable) fully breast supportive, bra as best seen in FIGS. 1 and 2. The bra 10 shown in FIG. 1 is of a general halter-top style or form and made of two breast supports or frontal convex (with respect to a viewer of the same on a wearer's body; concave from the front of the wearer) cups 12, one for receipt of each breast and several supporting straps (two pairs for extending behind the neck) and a waist strap for encircling the body, below the breasts. The preferred form is a halter style bra but other styles are within the scope of the present invention. The preferred material for the bra 10 is tubular knitted and elastic nylon, preferably formed from a nylon circular knitting machine of the kind used for making women's stockings or nylons. These tubes are made to appropriate dimension, flattened (thus becoming two-ply), cut and sewn as required to make the desired bra shape and components. Thus, the principal components of the bra product are two ply or layered tubular pieces of elastic nylon formed from circular nylon knitting machines. The commercially knit, tubular nylon is flattened, cut and sewn to form cup panels. The neck engaging straps of the halter style bra are narrowed strips of the tubular nylon material while the elastic neck piece, if provided (described hereinafter) and the waist band can be formed of other suitable negligee or bra materials or fabric. The cup panels and the upwardly extending straps (two pairs extending upwardly and the waist strap around the rib cage, extending to the neck and back, respectively, form the preferred style of the bra, a halter bra. This bra supports the breasts in a sling-like, backless fashion with comfort and, yet, separates, supports, locates and holds the breasts. The breasts are held by the bra, the bra holds them firmly forward, and at the desired orientation, position and placement and, yet, the entire bra is quite lightweight and very comfortable. The present bra provides the necessary strength and structure for breast support and does so without the need for any metallic underwire. This is very desirable as current bras on the market involve metal clasps, wires, and hardware and are often uncomfortable and/or heavy. Even further, conventional bras are visible under backless and strapless tops and dresses whereas the current embodiments of the present invention allows a woman to wear a backless or strapless dress or gown without the vertical extending shoulder straps and supporting structure being visible to an observer of the woman from the rear or back. While backless and strapless bras and connecting mechanisms for the straps exist today, such as strapless underwire bras and stick-on bras as well as plastic strap-connecting pieces for holding the back strap low (hopefully below the level of the dress in the back) none provide both comfort and sling or below breast support as the present invention. Even prior art and conventional strapless bras still have uncomfortable metal hardware for breast support and are difficult to keep from falling down and stick-on bras or bra cups are frequently made of too soft material, either silicones or plastic, and offer little to no real support for the breasts, their positioning with respect to the body and one another, nor for preventing sagging of the same; they simply cover the breasts.

The halter style of the inventive bra 10 comprises a pair of opposed or side to side located and arranged cup panels 13*a* and 13*b* which are generally made of circular knit nylon and flattened tubes (see FIG. 5C) folded and cut, seamed as required to each provide a generally L-shaped piece, i.e., with a large vertical leg and a laterally extending and shorter leg. The two L-shapes are mirror images of one another with the axis of the mirror extending down the vertical central axis of the bra. Basically, each L-shaped cup panel comprises a vertical leg, extending from a vertical front strap to a lower, bottom straight edge 15, the vertical leg being defined by an inside, central, and vertically extending, but suitably curved for look and comfort, cleavage forming edge 17, and a short side or backward and sideward extending panel 24 defined on its rear or side-most edge by an outside wall edge 19, another vertical but more rearward or side vertical strap and an opening 28, between the two vertical straps. The opening 28 is formed and bordered by the first vertical strap (an upward and narrowed continuation of the cup panel) and the rear or side strap, extending upwardly from the side panel 24. The opening 28 is also defined or formed by an outside opening or loop extending down from the top of the bra where the rear set of straps 33*a* and 33*b* meet behind the neck down to the short outside wall edge 19 and then back up to the rear edges of straps 27*a* and 27*b*, also held behind the neck. The front cup panels 13*a* and 13*b* are generally of an L-shape, indeed, the two panels form opposed but back to back L-shapes, with the vertical leg of the Ls narrowing upwardly to the front halter straps 23*a* and 23*b* and the horizontal L-leg of the cup panels being breast holding cups 25*a* and 25*b*. These pieces and components are preferably formed of the tubular or circular nylon knit material, pushed down flat, cut and seamed, as indicated. The general shape of the front cup panels 13*a* and 13*b* is somewhat like a capital "L" (for cup panel 13*a* and an opposed or mirror but backwards facing capital L for cup panel or element 13*b*).

Figure 5A:
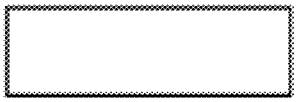
FIGS. 5A, 5B, and 5C are isometric views of the other components used for making the present inventive bra, namely a neck elastic piece or member (FIG. 5A), a flat elastic or waist band (FIG. 5B), and the tubular, (not yet flattened) knitted nylon lengths (for the cup panels) (shown in FIG. 5C), respectively.
Figure 5B:
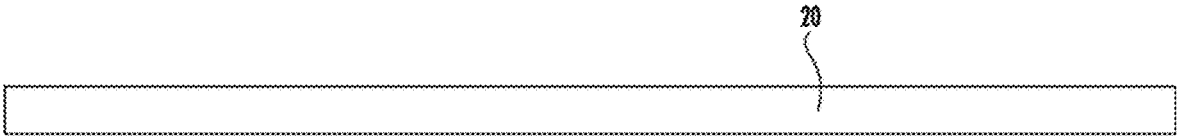
Figure 5C:
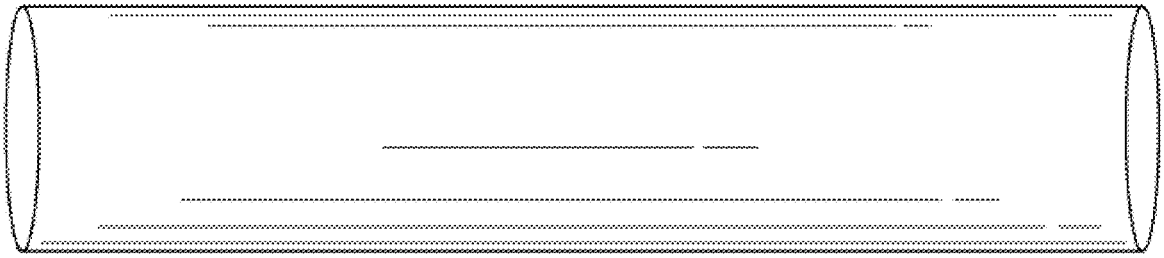

As can be seen in the Figures, the material is double thick and dense in those areas for sling support (below the breasts and to the sides as a support sling) and the Figures also show the increased rigidity of the material at the location when stressed by the breasts held therein. Stated differently, the central breast holding areas 25*a* and 25*b* are flimsy, light, and unstressed as they are elastically stretched to accommodate the breast held centrally therein. The below and side areas of each of the cup panels 13*a* and 13*b* are shown in darker lines or with more rigidity as a consequence of the stress and weight of the breasts on the below-located nylon, circular knit material. The below areas are under the stress and weight of the breasts and support the same from beneath and from the sides, as a sling. Thus, central breast holding areas 25*a* and 25*b* are shown as unstressed while the sling support beneath the breasts are shown in more solid or rigid fabric material, yet, they, of course, provide support to the breasts. The tubular, machine knit nylon tube for forming the cup panels 13*a* and 13*b* is schematically shown in FIG. 5C. Generally, each tube is originally about 4 inches in diameter, 13 inches in length and then flattened. More than one tube is needed, of course, to create a full bra formed of two cup panels. The halter style bra 10 is provided with a waist or torso encircling elastic band 20 suitably sized to the anticipated circumference of the wearer, e.g., 32 inches, 34 inches, 36 inches, 40 inches, etc. The band is elastic to comfortable hold the same snuggly in position but not so tight that the same is uncomfortable. Of course, hooks and eyes and/or Velcro like mechanical connections, button and button holes, etc. could be employed to allow some measure of fine adjustability to the circumference of the waist band 20. It, too, can be a knitted nylon band with similar or more supportive material as that provided in the waist or back engaging band of bras and/or of currently available commercial stockings and/or pantyhose. The waist band 20 extends generally around the wearer's rib cage, but below the breasts, about the sides of the wearer and across the lower back. The waist band 20, see FIG. 5B, can be a piece of flat elastic and is preferably about ½ inch in height and about 25 inches in length. The thickness is about that of current bra straps.

Figure 3A:
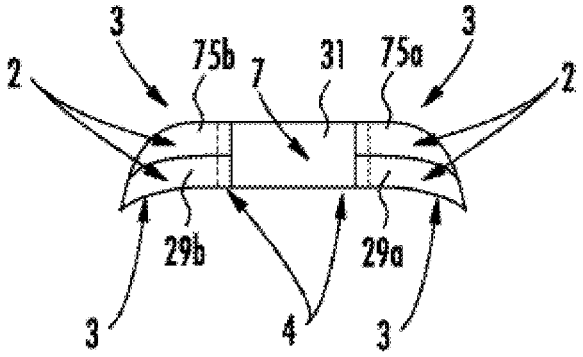
FIGS. 3A and 3B are rear views of the worn bra shown in FIG. 2, as worn by a woman and as would be seen when someone views the bra of FIG. 2 but from the woman's back. The neck engaging portion of the two pairs of straps and the rear of the encircling or waist strap are all that is visible, making the back of the woman substantially free of any indication of the support for the bra.
Figure 3B:
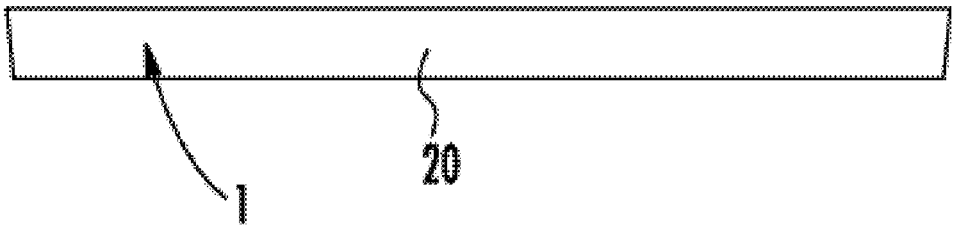
Figure 4A:
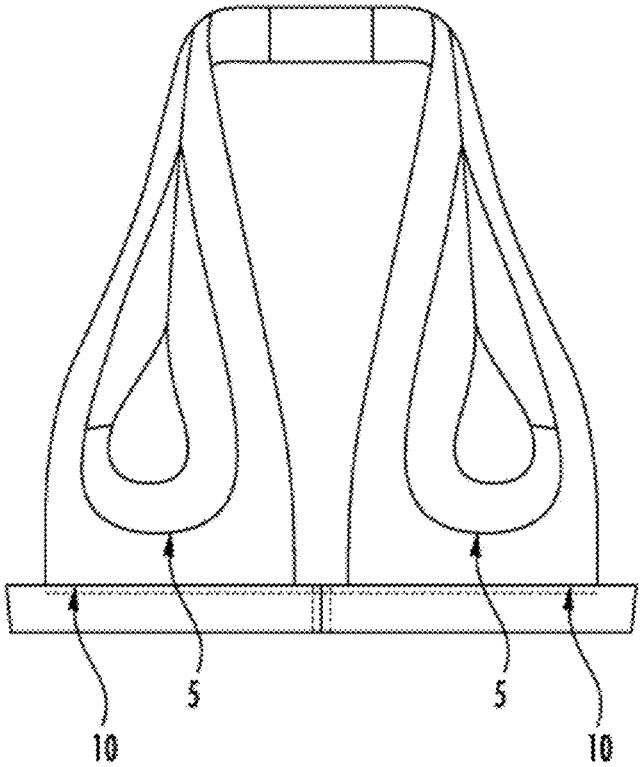
Figure 4B:
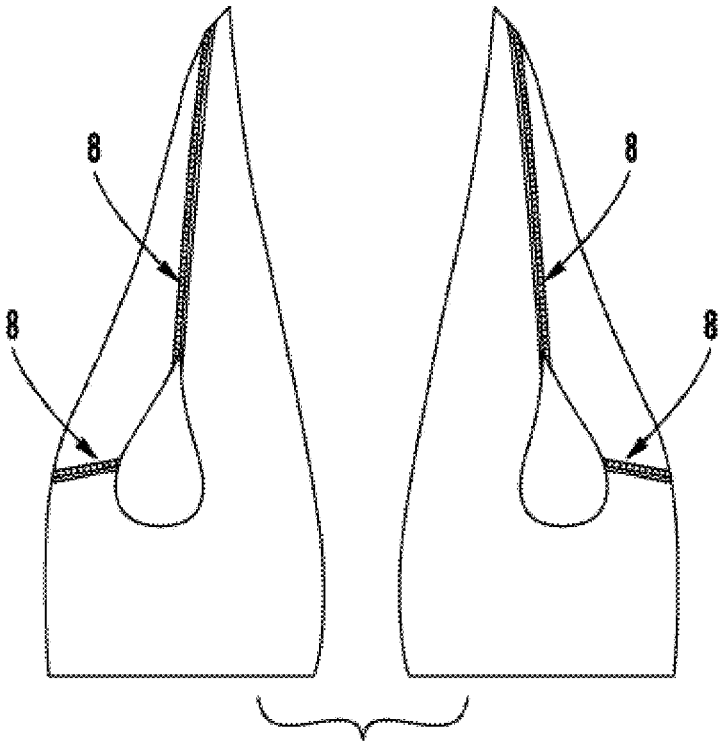
FIG. 4B is the inside or rear view of the cup panels of the bra shown in FIG. 2 and shows the seaming of the tubular pieces to one another to form the cup panels.

Small length segments at the front and top edge of the waist band 20 are sewn to (or fused or otherwise manufactured) to the horizontal straight edges 15 of each of the two cup panels 13*a* and 13*b*. The waist band 20 can be made of any known or preferred elastic, nylon, fabric material, as available in the field, including nylon straps, traditional smooth silk-like bra straps, or other material. The band should be elastic and comfortable. It may be provided on its skin contact side with silicon or other similar lining which frictionally yet comfortably holds the waist band in the preferred position around the wearer's front and at the proper vertical orientation or "latitude" around the wearer's sides to the middle or lower back. The location and relative position on and viewability of the waist band 20, from the rear of the bra 10, is shown in FIGS. 3A and 3B, which, while separate and distinct Figures, are meant to show the relative spacing of the top neck engaging part of the halter bra and the lower waistband 20, just as FIG. 2 shows the halter bra from the front.

The two cups of the bra, one for each breast, are each preferably formed from one continuous tubular yet seamed length of knitted nylon fabric (see FIG. 5*c*). Each is preferably constructed from one or more continuous knitted tubes of elastic nylon, similar to the output of a machine capable of making knitted circular nylon hosiery. According to the present invention, a length of the flattened nylon tube is folded, cut and seamed into the L-shapes, and a smooth and finished seam is provided at the cleavage edge 17 and at the outside wall edge 19. The bottom edges 15 of the cup panels 13*a* and 13*b* are sewn to the segments of the top of the waist band 20. As can be seen in the Figures, the nylon tubular knitted material continues sidewise and rearwardly from the side panels and the outside wall edge 19, preferably with only one or a few seams, narrowing upwardly and extending into a strap towards the neck of the wearer. A pair of rear straps are thus formed, one strap 33*a* and 33*b* from each cup panel 13*a* and 13*b*. The side panels narrow as they proceed towards the rear and upwardly and form rear straps 33*a* and 33*b* and are connected, see FIG. 3A, to an elastic neck piece 31. Alternatively, the rear straps 33*a* and 33*b* are endlessly connected to one another as if they are a continuous strip/strap of the knitted tubular nylon fabric, i.e., they connect to one another without any intermediate elastic neck piece.

A pair of opposed, central, opening-defining strips or straps 27*a* and 27*b* are formed on the front of the neck panels, formed from an upwardly and narrowing extension of the cup panels. These straps 27*a* and 27*b* are the vertical legs of the L-shaped cup panels. These narrow, terminate and are seamed, too, to the elastic neck piece 31, just above the ends of the rear straps at the elastic neck piece. A pair of short neck strap connection segments 29*a* and 29*b* are formed for the connection between the straps and the elastic neck piece. The ends of the straps are sewn to an elastic neck piece 31 (see FIG. 5A). Preferably it is about ½ to 1 inch in height and only about 3 inches in length. It is thin and elastic to accommodate fine differences in body types and sizes of women. In some embodiments of the present invention, the narrowing of the cup panels does not terminate behind the neck and is not sewn to an elastic neck piece 31 but, rather the straps are a continuous or endless nylon path formed and extending from the cup, up a strap, behind the neck, to the other strap and to the other cup. With respect to the rear set of straps, the continuous strap extends from the rear edge of the side panel, up the strap, across the neck, and down as another strap secured to the rear edge of the other side panel. However, in the shown embodiment of the Figures, the tubular knitted nylon cup panels 13*a* and 13*b* are narrowed into small width straps which are sewn to the elastic neck piece 31 (see FIG. 3A).

The outside or rear edge 19 of the L-shaped cup panels are only visual edges of the drawings in that they appear that way when viewed in the Figures. In actuality, however, the sides of the L-shaped cup panels continue slightly around the side of the breast of the woman to hold the same within the cups so formed. The cup panels extend, upwardly, and narrow into strips or rear strap like pieces 33*a* and 33*b*, for L-shaped cup panels 13*a* and 13*b*, respectively. These too are knitted tubular nylon and have an outside and finished fold edge. These strips or narrow rear straps 33*a* and 33*b* extend from the rear of the short outside wall edges 19 upwardly towards the neck and meet one another behind the wearer's neck (see FIGS. 1, 2 and 3A). In one embodiment, the straps 33*a* and 33*b* actually physically merge or are integrated into a single continuous nylon piece extending behind the wearer's neck while in another embodiment, the two straps 33*a* and 33*b* meet preferably behind the wearer's neck and can be secured to one another by hooks and loops, buttons and button holes, Velcro hook and loops, etc., and/or with the elastic neck piece therebetween. In another embodiment, i.e., the embodiment shown in FIGS. 1 and 3A, the straps 33*a* and 33*b* terminate and are sewn to the outside walls or edges of an elastic neck piece 31 (see FIG. 3A).

In another embodiment (and the currently preferred embodiment) of the present invention, shown in FIG. 2, the tubular or flattened cylindrical knitted nylon elements start at the top—as two straps down the center of the bra, each with one end first sewn to a single elastic neck piece 31. The pieces then extend down towards the waist band 20 while widening into the cups for the breasts of the wearer, are secured to the waistband 20, and then extend slightly rearwardly and then back upwardly as another pair of straps towards the same elastic neck piece. In this embodiment, as shown in FIG. 2, the central and bottom of the cup panels, 53*a* and 53*b*, are more tear drop shaped. The tear drops 55 are formed from the tubular knit tubes being folded upon themselves and seamed with a teardrop shape. There are two primary straight seams, 70 and 71 and a looped seam 73. One seam 70 runs substantially vertically and connects the frontal or first strap to the rear or second strap, all of the single tubular nylon piece. A looping or teardrop shaped seam 73 is provided to the tubular knit nylon piece, proximal to the center of the woman's breast of the cup panel. A short seam 71 gathers the tubular element of each cup panel and extends from the lower and outward portion of the looping seam 73, extending slightly downwardly, to the outside edge 83*a* of the rear straps. As can be seen, the front cup panels, formed of tubular and knit nylon material, provide soft, comfortable, elastic holding pockets for the breasts of the wearer. The nipples of the breasts are likely to be located somewhere proximal to the center or below of the looping seam 73. A woman can easily put the bra on, with the straps held behind the neck and then selectively position and locate the breasts, as desired, i.e., close to one another to accentuate cleavage, separate, high or low, etc. The cup panels support the breasts, hold them naturally and with separation, in a very comfortable manner. The tubular nylon, under the weight of the breasts, becomes rigid and supports the breasts in a sling like manner from beneath. So, too, the side panels extending rearwardly; they support the breasts and become rigid while the rest of the bra is soft and supple, entirely comfortable, as those areas are not stressed nor rigid. The bra is very lightweight, and, yet, uses the elasticity and strength of the nylon tubular material to hold and support the breasts with the weight of the same supported in the sling and, in this embodiment, to some degree, support is provided behind the wearer's neck. The waist band also supports and locates the bra and the breasts. Again, it extends below the breasts, across the front of the wearer, backwardly along the sides and across the mid to lower back. Silicone can be provided to facilitate the maintenance and location of the waist band, as desired.

For this halter style of bra, the narrowing of the tubular segments as the cup panels travel upwardly and form two pairs of support straps, as the material extends toward the elastic neck piece 31, allows the device to support the breasts with minimal material, minimal viewing of the supporting straps, maximum comfort, and without metal wiring. Of course, the breasts are primarily supported and placed by the rigidity provided by the nylon or elastic material located below and adjacent the breasts as those areas become rigid under the weight of the breasts. The narrowing strips or straps, secured to the elastic neck piece (if provided), held behind the wearer's neck, is an extremely comfortable and efficient manner of supporting breasts in a natural manner. The waist or torso encircling band holds the cup panels 13*a* and 13*b* in relative position and ensures that the overall bra does not ride up the torso. As mentioned, the band can be provided with silicone or another skin sensitive adhesive to provide some level of friction to facilitate the holding of the band 20 in relative position, wrapping around the wearer but below the breasts.

As seen in FIG. 2, the preferred embodiment of the halter version of the invention, the upper and narrowed pieces (the vertical and front legs) of the L-shaped cup panels 13*a* and 13*b* form front straps 75*a* and 75*b* (FIG. 3A shows this, too). Here, too, the straps terminate behind the neck of the wearer in an elastic neck piece or as a single continuous piece of nylon tubular material. The elastic neck piece is shown in FIG. 3*a* with the ends of the two sets of straps sewn to the edges of the neck piece. The narrowing of the tubular segments as they turn about the side of the wearer (the horizontal leg of the L) for the outside surfaces (towards the sides of the wearer, not the chest bone) of the cup panels become the rear set of straps and also terminate as strips or short strap segments 77*a* and 77*b*. These, too, can be sewn to the elastic neck piece, see FIG. 3A. As shown in FIG. 3*a*, the rear straps are secured to the elastic neck piece below the securement of the front straps to the elastic neck piece. Alternatively, the rear straps, too, can be a substantially continuous tubular piece of knit nylon. If an elastic neck piece is used, the connection formed by the straps 75*a*, 75*b*, 77*a* and 77*b*, can be provided with some adjustment by Velcro hooks and loops, buttons and button holes, hooks and loops, etc. In any event, as should be quite apparent, in this embodiment, two pairs of neck-engaging short strap segments are provided and one set, at the rear of the neck, overlies the other. The straps and/or the elastic neck piece lie against the skin of the rear of the neck of the wearer.

When the bra is to be worn, the wearer will pass the waist band 20 over her head until it is just below the breasts and around the rib cage, around the sides and towards and near the lower back. Then, the elastic neck piece (if provided) or the thin segments of the two sets of straps 75*a*, 75*b*, 77*a* and 77*b* are placed behind the neck of the wearer. The breasts are easily moved, if necessary, such that they are within the cup panels, with the center of the breasts held, as desired, normally near the middle of the panels (proximal the tear-drop shapes defined by the looping seam 73) and the breasts supported, vertically, by the sling-like support of the bottom of the L-shaped cup panels made of the nylon tubes. Most of the weight is thus supported by the rigid nylon tubes while some of the weight, in this embodiment, is supported, too, by the elastic neck piece, behind the wearer's neck or the straps themselves behind the neck. The cleavage edge 17 and the outside wall edges 19 of the cup panels provide the inside and outside, respectively, seamed edges to the bra. The torso or waist encircling band helps to hold the bra in vertical location and to further support the breasts in a relative vertical and horizontal position on the body. The breasts are thus primarily supported by the knit nylon, tubular cup panels 13*a* and 13*b*, when made rigid under the weight of the breasts with the remaining areas of the bra remaining sheer and soft. The side panels also are made rigid under the weight of the breasts and together with the elastic nylon tubes beneath the breasts provide substantial support to the wearer. Some weight is borne by the straps extending behind the neck. The elastic neck piece is connected to the straps at narrowed pieces 75*a* and 75*b* and 29*a* and 29*b*. The straps with the elastic neck piece of course provide some support for the halter style of the bra to hold the breasts upwardly and cooperate with the waist band 20.

The side edges 19 extend slightly rearwardly, along the wearer's side, but not fully around to the back. Rather, the side panels upwardly extend into, narrow strips and form the pair of rear straps 25 and 27. The knit, tubular and nylon fabric is preferred because it is lightweight, can be tubularly formed from conventional nylon knitting machines, is elastic yet supportive, as it becomes quite rigid when under the weight of the above-located breasts. It is also inexpensive, easily washable, sheer when not weighted, can be formed of a variety of skin tones and colors, and is soft to the wearer's skin. The bra can be inexpensive enough to possibly even be disposable after a predetermined number of usages.

The bra creates a sling-like support system for the breasts as the bottom of the breasts are supported from underneath and held upwardly by the rigidity of the elastic nylon under the weight of the breasts. In the halter version of the bar, the nylon extends upwardly and into continuous strips or straps of material which also help to carry the weight of the breasts so that some weight and support is provided by the neck. In all embodiments, the elastic nylon tubular material, when subjected to the weight of the breasts, becomes rigid and provides a sling like under-support for the breasts, allowing the same to remain in position and to look entirely natural. The breasts are seemingly supported in a fully natural and comfortable manner.

The cup panels cover the breasts while the outward and slight rearward short panels are positioned at the outer edge of the breast to create structure and maintain the breasts in a forward position. This support is also provided by the tubular nylon material becoming rigid under the weight of the breasts, now from the side. In the preferred embodiment, as the outer panel is stressed or tightened by the holding of a breast, it becomes rigid, as is typical of knitted nylon tubing when pulled, and it is able to firmly yet comfortably reinforce the breasts' natural shape and forward position. The center of the inner cup panel forms a cup which expands when worn to make room for the breasts such that they can be held in their natural shape rather than being compressed. At the same time, segments and areas of the nylon tubing, the side panels, cup panels, are pulled, tightening and becoming rigid, the bra becomes quite supportive of the breasts, from below. The straps at the neck and the rear of the band around the waist help the support, in the halter version of the bra.

The support straps continue from the side panels toward the neck where they are attached to a strap holding segment (called the elastic neck piece) for securing behind the neck of the wearer. A portion of support or halter straps may be, like the waist band, made of any strap material known and used in the industry. Alternatively the straps of one cup panel may join with the strap of the other cup panel directly, i.e., endlessly or without interruption, continuously, to create an integrated pair of (each of double thickness) strap segments located behind the neck, Yet, an integrated strap segment is not necessarily required and each strap segment can be separable into ends which mate and hold the same behind the wearer's neck.

In a second embodiment, the present invention is also directed to a garment that may be constructed in a t-shirt bra style, which may include straps extending from the front panels or support cups over the user's shoulders to a back position of a band that surrounds the user's abdomen or torso or a back position of the garment.

As previously described, the materials used to construct the garment of the second embodiment may include a soft, elastomeric or mechanical stretch material knit or sewn into a tube shape around a cylindrical form such as that of a tubular knit machine. A mechanical stretch material may also be woven or non-woven. The elastomeric or mechanical stretch material may include one or both of an elastomer and nylon. The types and relative proportions of the elastomer and nylon in the elastomeric or mechanical stretch material may be selected based on the desired degree of elasticity or stretch of the material.

Figure 6:
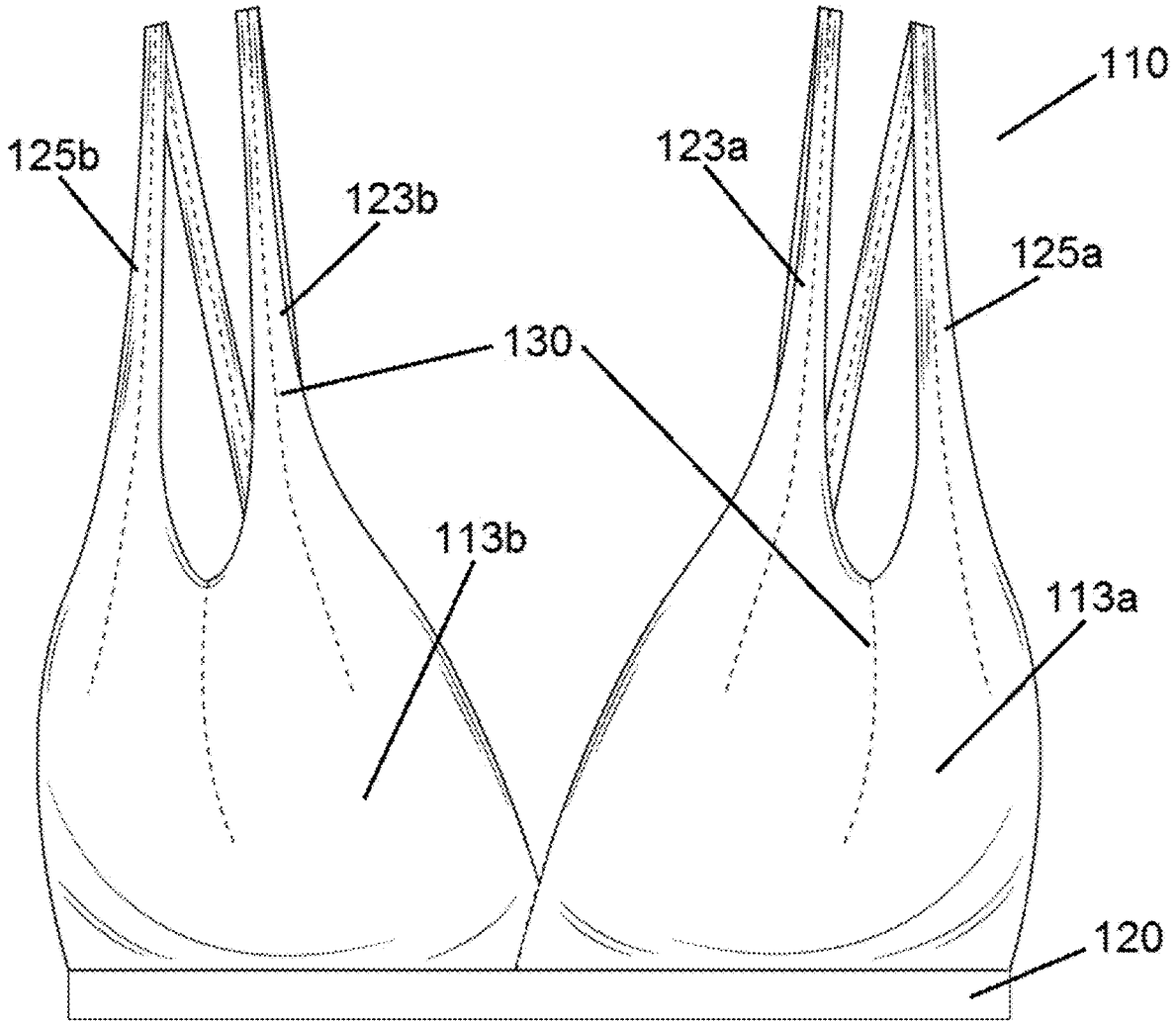
FIG. 6 shows a front elevation view of a bra according to a second embodiment of the present invention in a first configuration.

The second embodiment of a t-shirt bra-styled garment of the present invention is illustrated in FIG. 6, in which a bra 110 includes a pair of front panels, namely first panel 113*a* and second panel 113*b*, and several integrally formed straps, namely first inner strap 123*a*, second inner strap 123*b*, first outer strap 125*a*, and second outer strap 125*b*. Each front panel and its integrally formed straps may be formed from the tube-shaped, elastomeric or mechanical stretch material disclosed herein. Preferably, each front panel and the pair of straps extending from and integrally formed therewith, e.g., first panel 113*a*, first inner strap 123*a*, and first outer strap 125*a*, may be formed from a single tube of the elastomeric or mechanical stretch material, thus forming a continuous piece that includes both the straps and the front panel. For each front panel and integrally formed straps, the tube of elastomeric or mechanical stretch material from which the panel and straps are formed is sewn so that the top portion of the panel leads continuously into two separate straps, e.g., panel 113*a* is adjacent and connected to both first inner strap 123*a* and first outer strap 125*a* at a top portion of first panel 113*a*, as illustrated in FIG. 6.

Each front panel and integral straps may be formed from a tube of the elastomeric or mechanical stretch material. The tube-shaped material may be folded and sewn to form the front panel and integral straps. By forming each front panel and integral straps from a single tube of the elastomeric or mechanical stretch material, a double-layered panel and strap piece may be produced. The two front panels of a single garment or bra may be symmetrical, or may have different sizes or shapes.

By forming each front panel and integral straps in this manner, the piece may have flat folded seamless edges, which means that there are no seams or stitching necessary or present on the free edges or peripheries of the front panels and straps. In alternative embodiments, however, these free edges or peripheries may be affixed to additional components, including but not limited to lace(s), trim(s), and other similar decorative features. In certain examples of this embodiment, the only required or desired stitching may be at central portions of the front panel and straps. As shown in FIG. 6, seams or darts 130 may be made in the interior portions of the front panels and straps, e.g., to assist in forming a U-shaped cradle-like structure that retains the user's breast.

As shown in FIG. 6, for example, each of the front panels and integrally formed straps may also be affixed to a stretchable band 120 encircling the user's abdomen. The bottom edges of first panel 113*a* and second panel 113*b* may be affixed to a front side of band 120, while top edges of first inner strap 123*a*, second inner strap 123*b*, first outer strap 125*a*, and second outer strap 125*b* may be affixed to a back side of band 120. First inner strap 123*a* and first outer strap 125*a* may be affixed to band 120 at a different position from second inner strap 123*b* and second outer strap 125*b*. Alternatively, the stretchable band may be formed in a manner such that the band has a seam or is seamless. The garment or bra may be constructed such that the two panels attached to the band have a gap, meet or touch, or slightly overlap at the center of the garment or bra.

The bottom edges of the panels and the top edges of the straps may be affixed to the band by sewing or bonding adhesive. The band may be any industry-acceptable band with stretch, such as one made of an elastic nylon fabric material, including but not limited to the elastomeric or mechanical stretch material described herein. The band may be made from a soft, elastomeric or mechanical stretch material, including a band knit or sewn into a tube shape around a cylindrical form such as that of a tubular or circular knit machine. While a band may be included in certain embodiments of the present invention, such as particular bras described herein, there are also embodiments of the present invention which do not include a band, such as a garment in which the front panels and straps are affixed to the garment at another location and not to a band. One such garment may be a body suit.

Since the front panels and integral straps are formed from a continuous fabric, the garment or bra of this embodiment is capable of being significantly stretched and manipulated. When the user wears the garment or bra, i.e., when a breast is placed in a front panel, the front panel is stretched to fit and hold the breast in an extended position in which the elastomeric or mechanical stretch material becomes stretched and taut, including at a position under the breast, with the amount of stretching including but not limited to the maximum extent of stretch possible for the material. Accordingly, the garment or bra of the present invention is able to support the breast without requiring any underwires as in prior traditional or conventional bras.

Figure 7A:
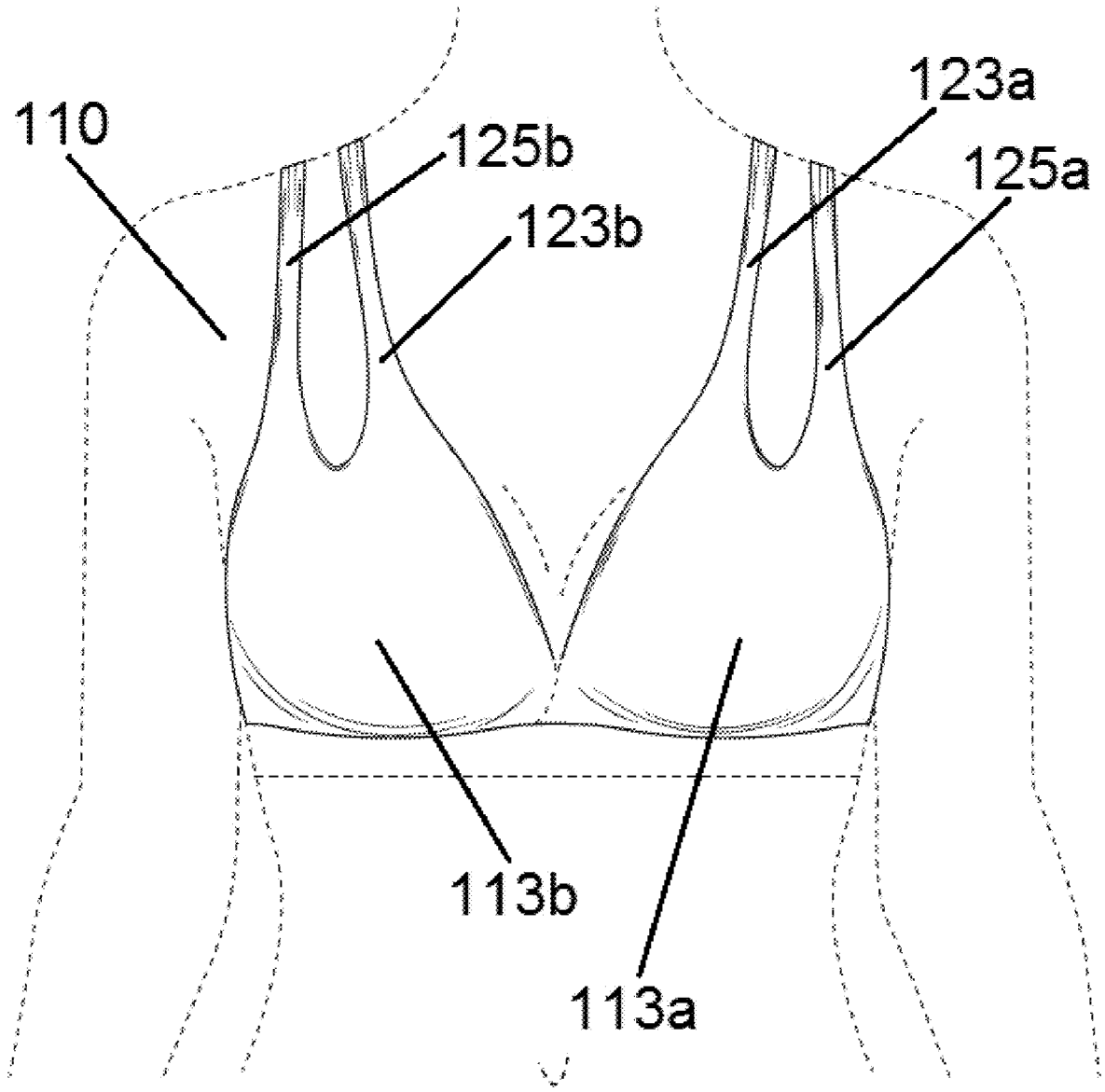
FIGS. 7A and 7B show front and back elevation views, respectively, of the bra of the second embodiment of the present invention as worn by a user in the first configuration.
Figure 7B:
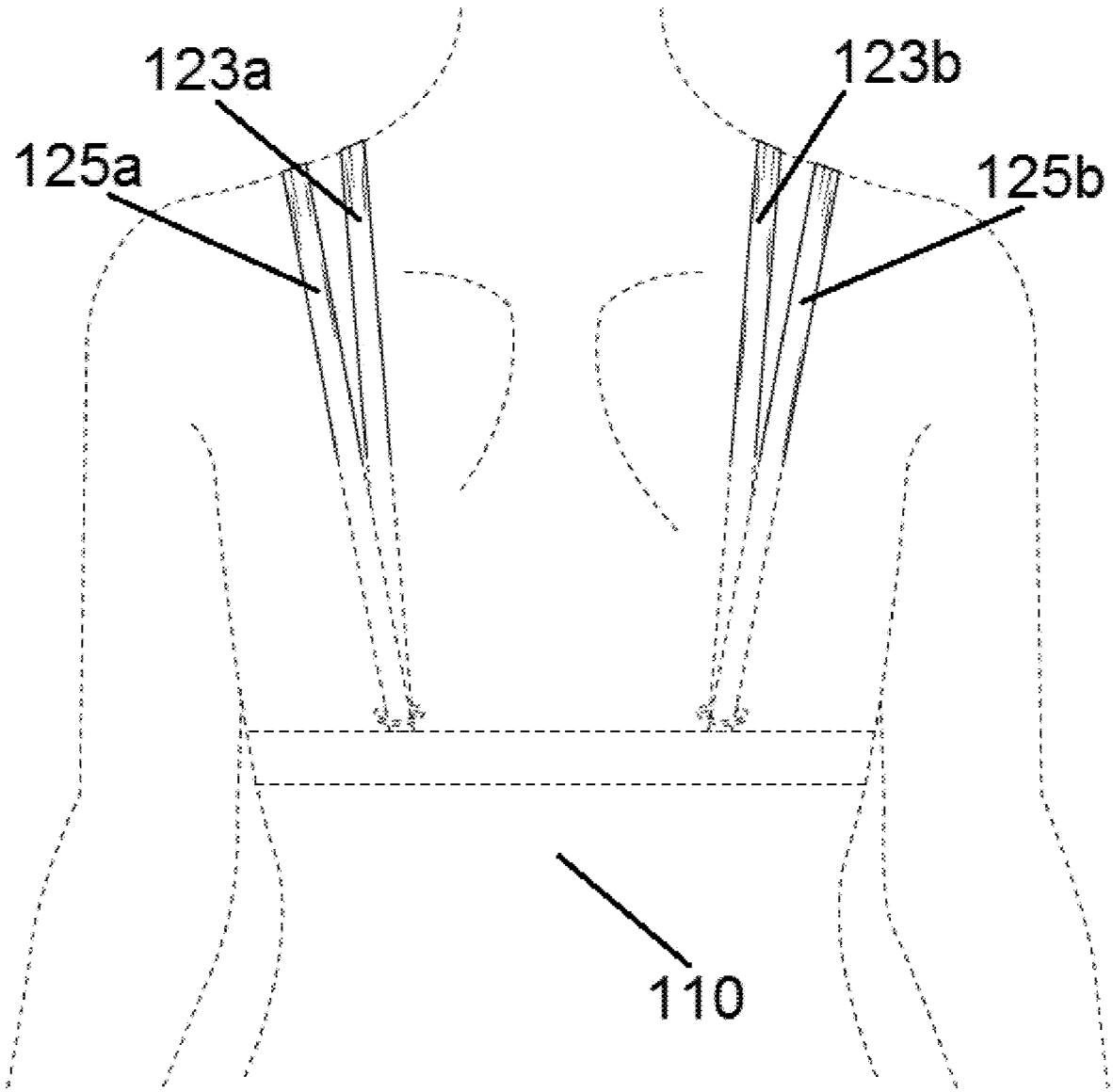
Figure 8A:
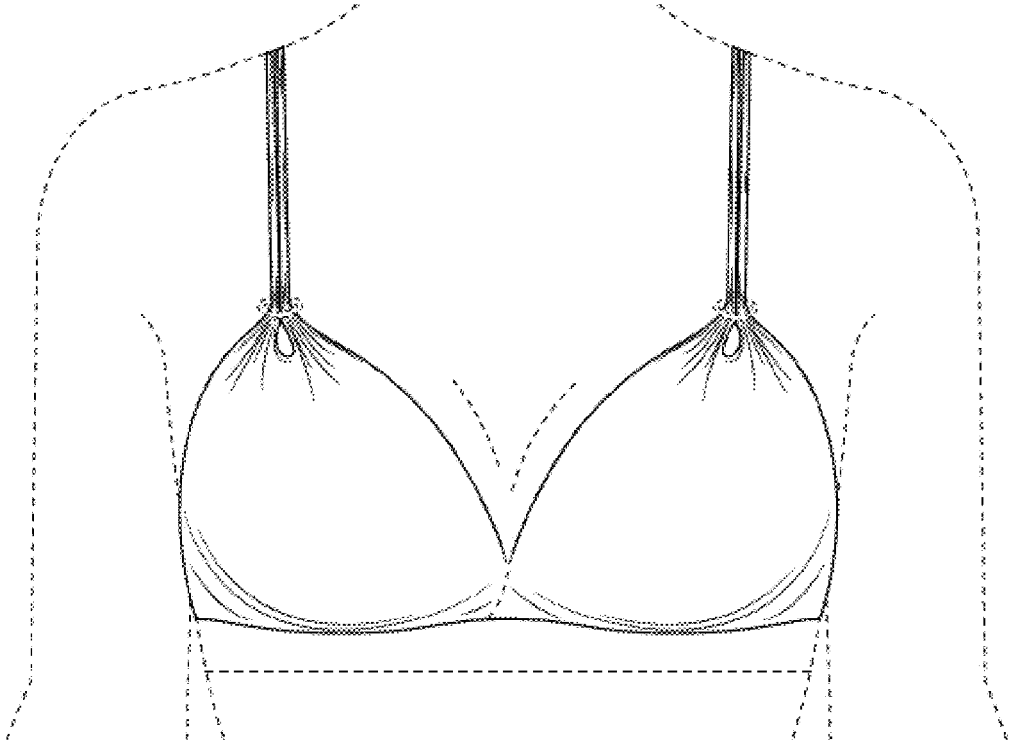
FIGS. 8A and 8B show front and back elevation views, respectively, of the bra of the second embodiment of the present invention as worn by a user in a second configuration.
Figure 8B:
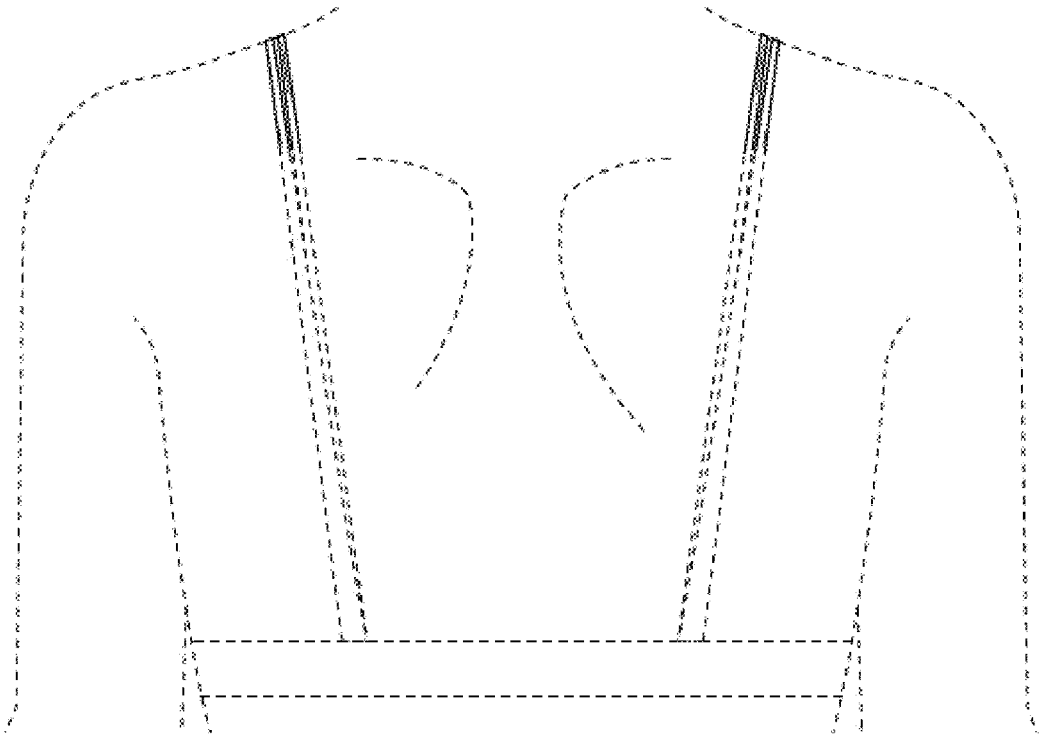

FIGS. 7A and 7B show one configuration of the embodiment of the bra of FIG. 6, in which a user wears bra 110 in a manner in which the pairs of straps are disposed on and over respective shoulders of the user, e.g., first inner strap 123*a* and first outer strap 125*a* are over the user's left shoulder and second inner strap 123*b*, and second outer strap 125*b* are over the user's right shoulder. In the embodiment shown in FIGS. 8A and 8B, a ring may be disposed on each of the first and second sets of straps, e.g., first inner strap 123*a*/first outer strap 125*a* and second inner strap 123*b*/second outer strap 125*b*. The ring may be moved up and down the sets of straps to adjust the spacing between inner and outer straps. FIG. 8A shows a configuration in which the ring has been moved to a position close to where the front panel portions transition into the strap portions. Placing the rings in such a position keeps the inner and outer straps together or substantially together, as illustrated in FIGS. 8A and 8B. The closed or closable ring of this configuration may be made out of any industry-acceptable material, including but not limited to silicone.

Figure 9A:
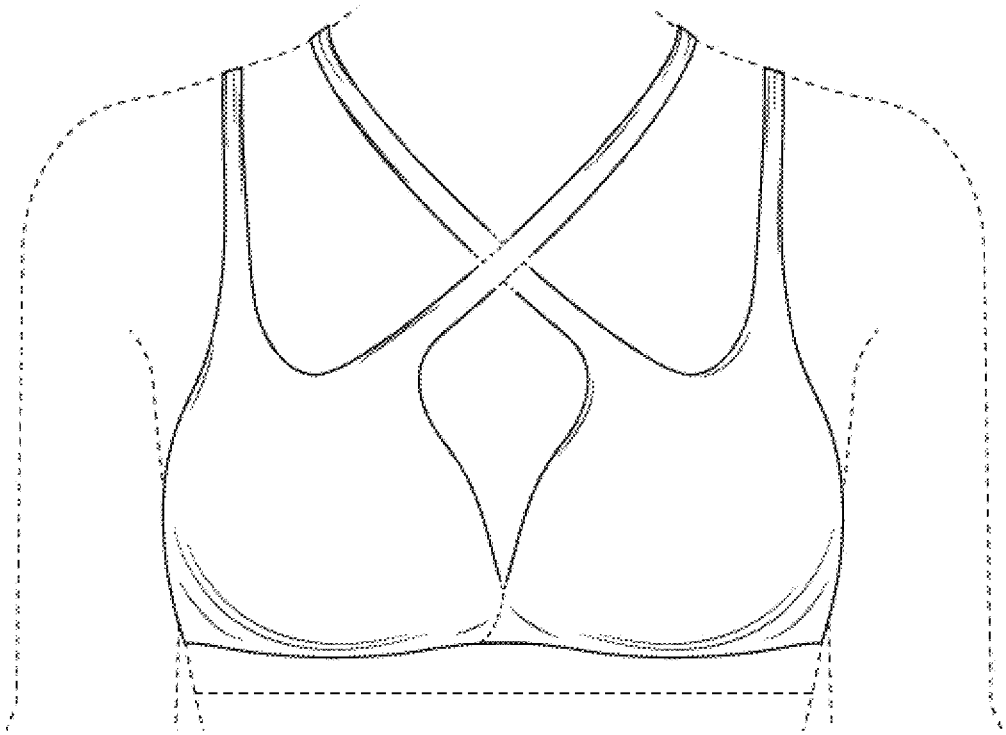
FIGS. 9A and 9B show front and back elevation views, respectively, of the bra of the second embodiment of the present invention as worn by a user in a third configuration.
Figure 9B:
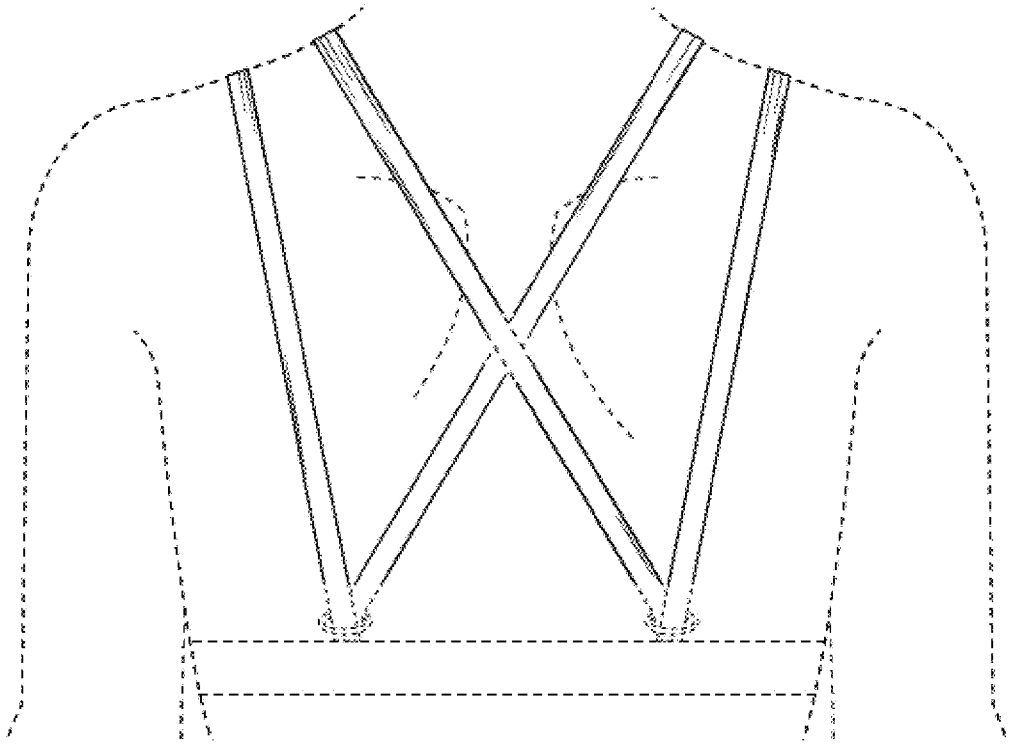
Figure 10A:
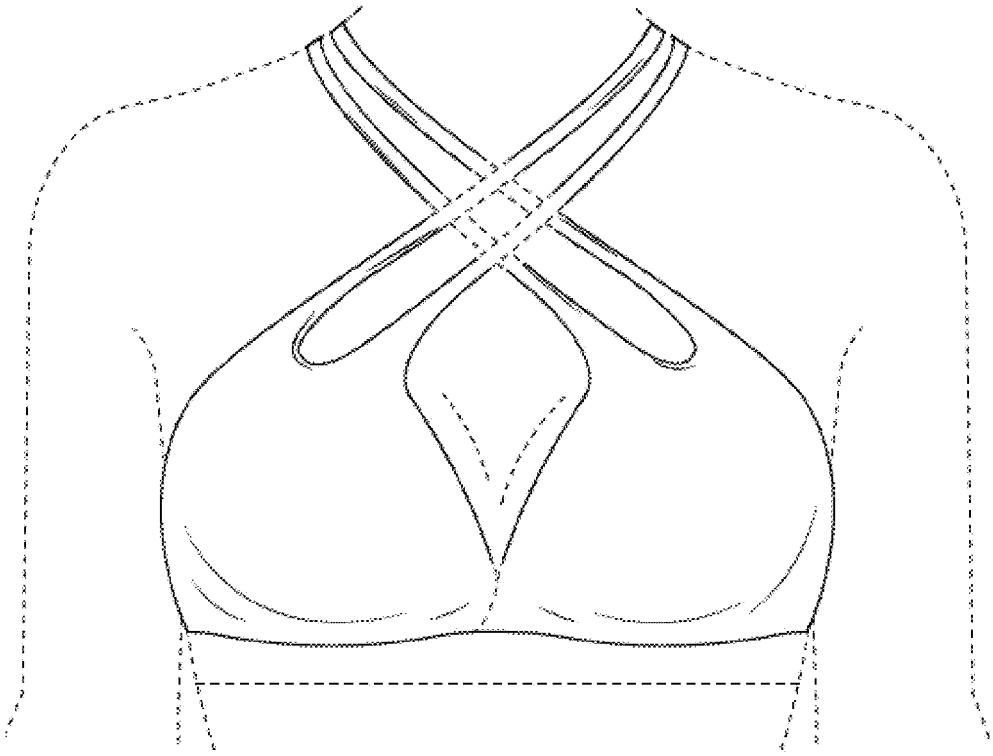
FIGS. 10A and 10B show front and back elevation views, respectively, of the bra of the second embodiment of the present invention as worn by a user in a fourth configuration.
Figure 10B:
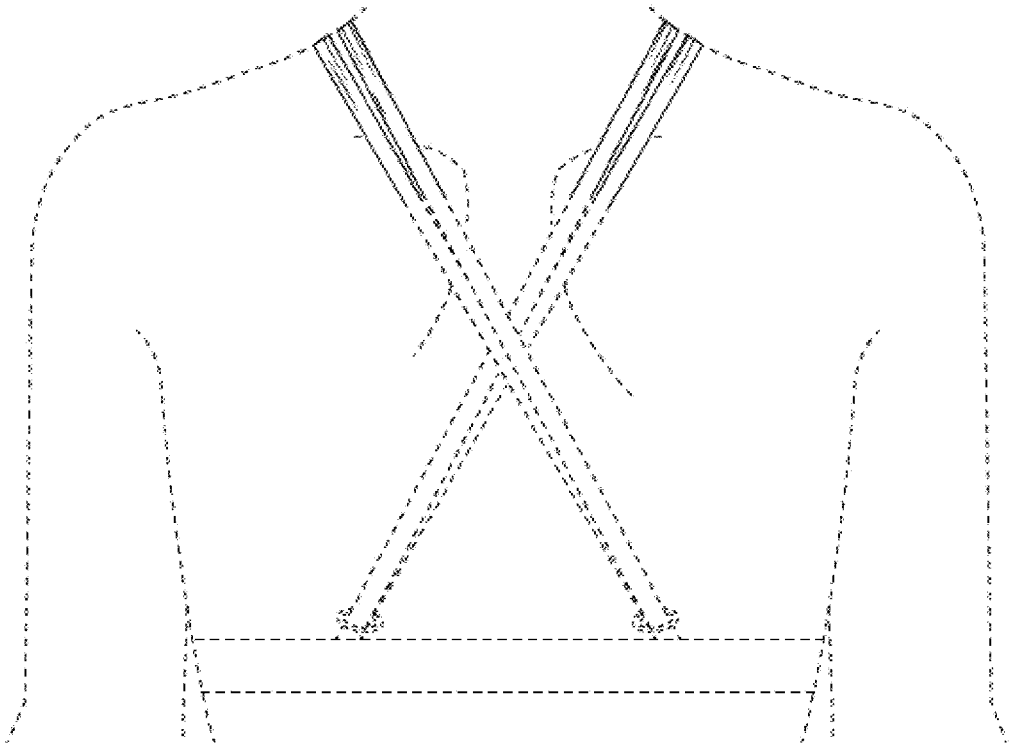
Figure 11A:
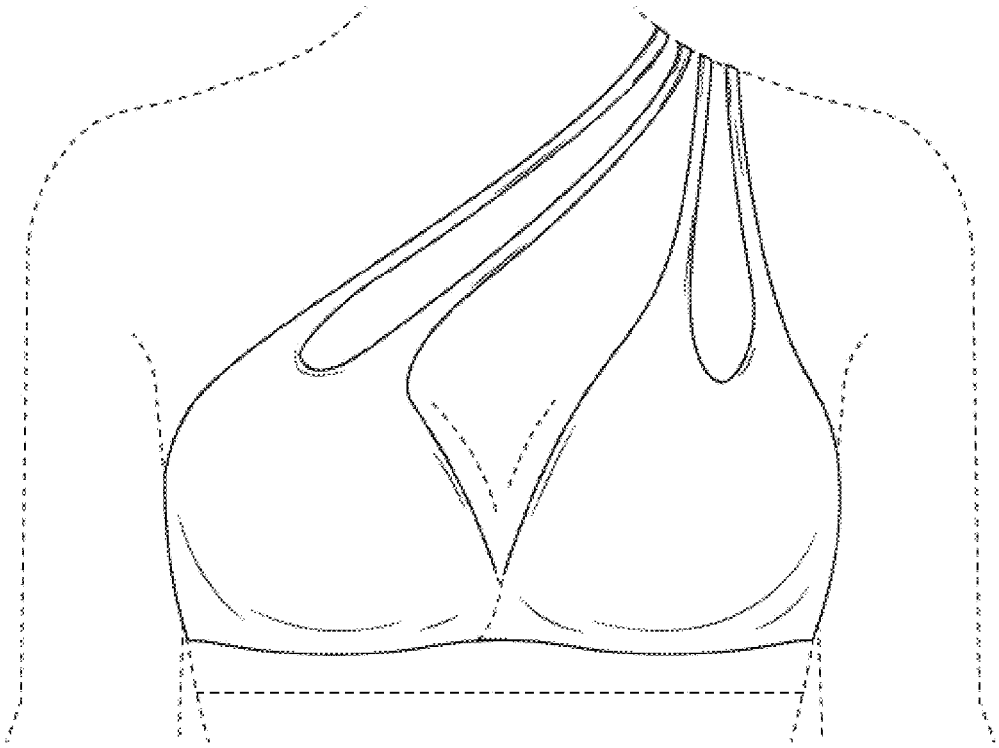
FIGS. 11A and 11B show front and back elevation views, respectively, of the bra of the second embodiment of the present invention as worn by a user in a fifth configuration.
Figure 11B:
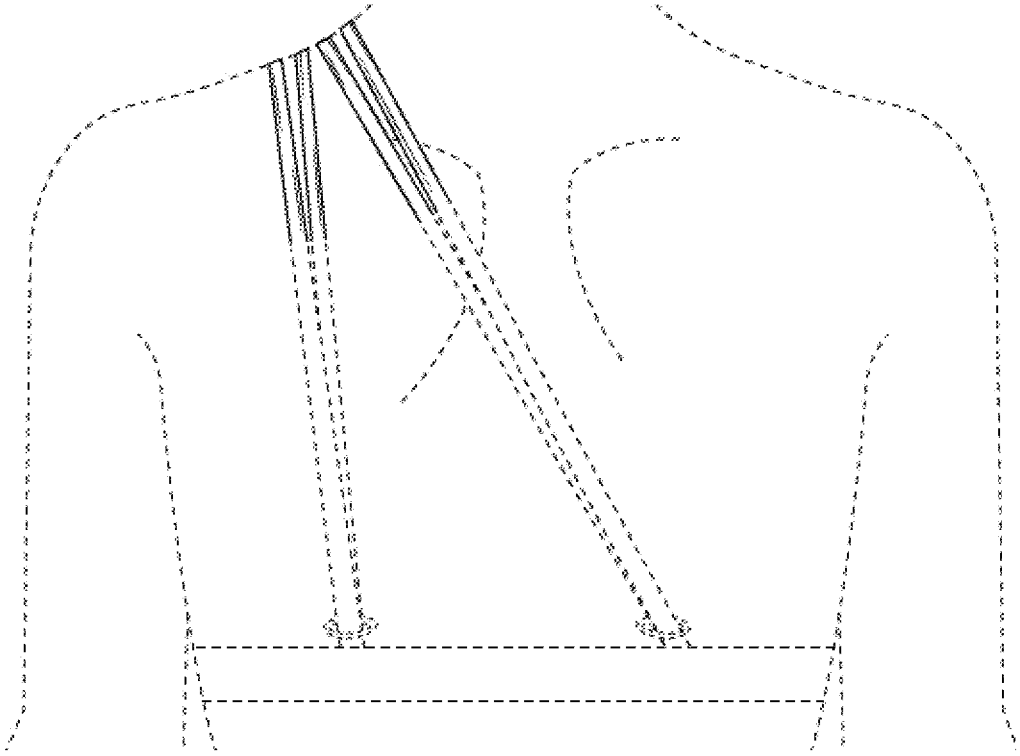
Figure 12A:
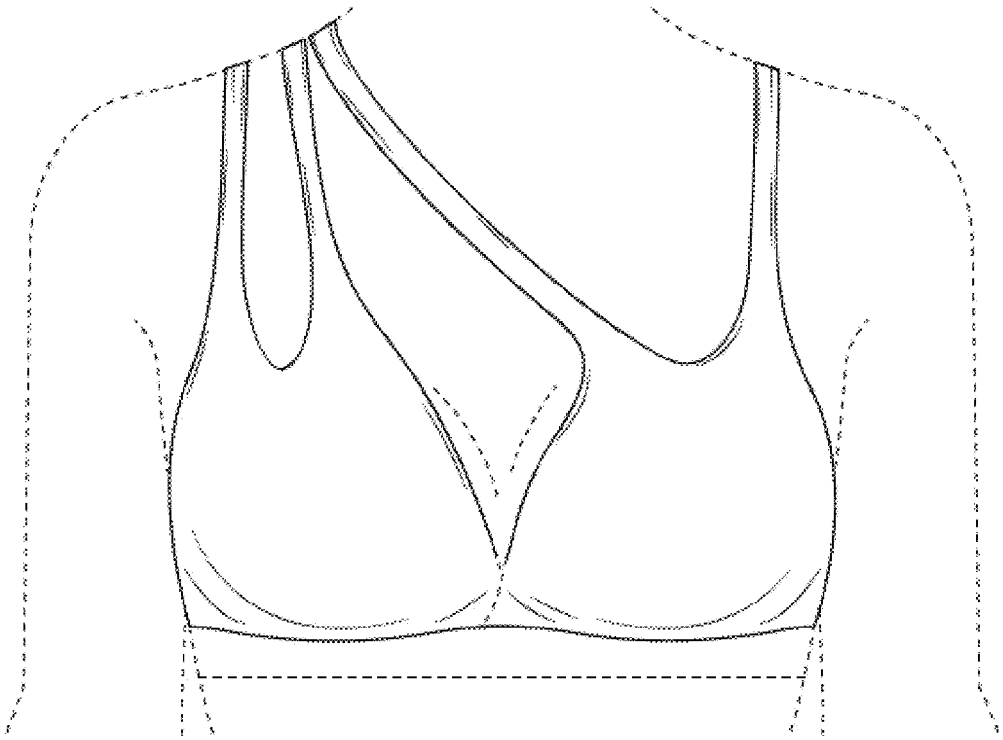
FIGS. 12A and 12B show front and back elevation views, respectively, of the bra of the second embodiment of the present invention as worn by a user in a sixth configuration.
Figure 12B:
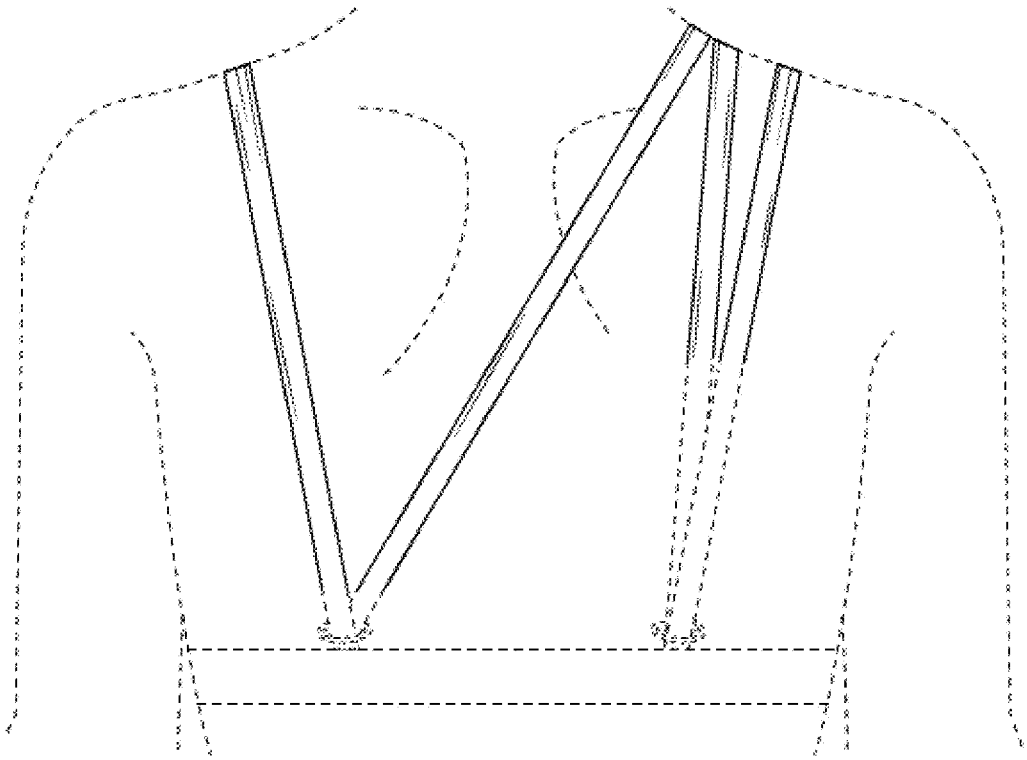
Figure 13A:
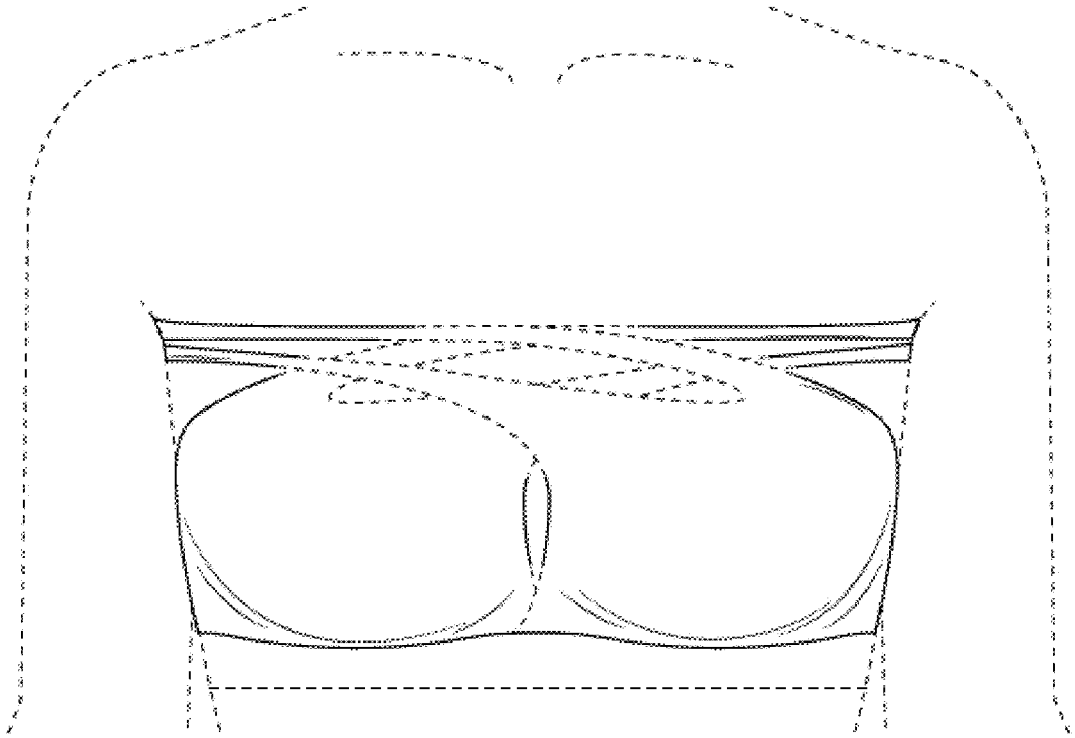
FIGS. 13A and 13B show front and back elevation views, respectively, of the bra of the second embodiment of the present invention as worn by a user in a seventh configuration.
Figure 13B:
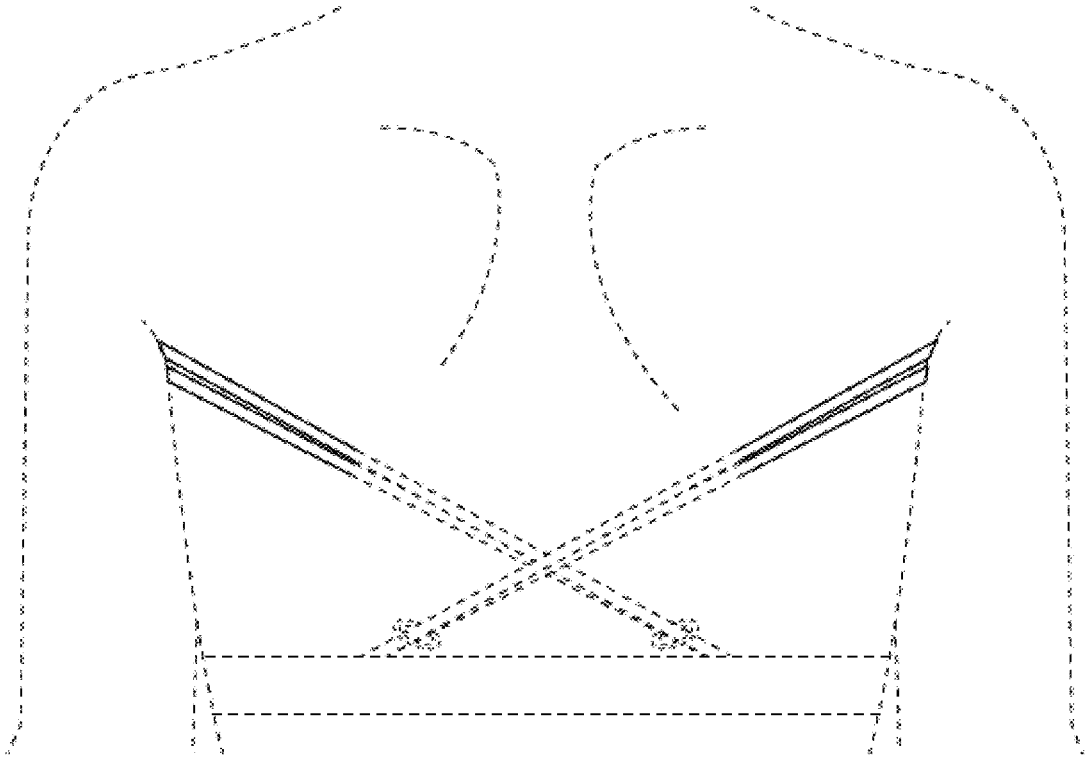

FIGS. 9A, 9B, 10A, 10B, 11A, 11B, 12A, 12B, 13A, and 13B illustrate various configurations in which straps have been adjusted, which is a result of the composition and arrangement of the bra as described herein. In FIGS. 9A and 9B, the inner straps are crossed over the user's head, while the outer straps remain on respective shoulders. In FIGS. 10A and 10B, both the inner and outer straps are crossed over the user's head. In FIGS. 11A and 11B, one set of inner and outer straps are crossed over the user's head while the other set of inner and outer straps remain on the shoulder closest to the front panel with which they are integrally formed. In FIGS. 12A and 12B, the bra is shown worn in a traditional fashion except that one inner strap is crossed over the user's head. In FIGS. 13A and 13B, both sets of straps are crossed over the user's abdomen and do not rest on the user's shoulders.

The foregoing are exemplary configurations highlighting the advantages of the construction and stretchable composition of the garment or bra of the present embodiment, particularly with respect to the straps integrally formed with the front panels. Moreover, while the garment or bra of the second embodiment is shown as configured in a t-shirt bra style, the materials, elements, and aspects described in this embodiment may also be applied equally to the halter-style bra of the first embodiment described herein.

The garment or bra of this embodiment, as well as any other embodiment of the present invention, may be configured and produced in varying women's sizes. For certain sizes, an elasticized support material may be added to portions of the garment or bra, such as the straps. For example, for providing greater tensile strength, the support material may be a stretchable tape or stabilizer added to or sown into or next to the seams of the straps, or a fabric through a yarn, a tensioning element, or a different knitting construction integrated into the straps. The stretchable tape or stabilizer may be any industry-acceptable polymer-based stretchable tape or stabilizer.

It may be advantageous to provide both waist bands and segments of the straps of the same or different materials and configurations to provide alternative bra options for various activities and preferences. The cup dimensions will vary by size and, yet, it will be appreciated that by use of the tubular nylon pieces, a single bra size is adaptable and capable of supporting a variety of breast sizes and geometries as the rigidity of the sling support beneath the breast is a function of the weight of the breasts. A medium size of the halter style of woman's bra, seen in FIG. 2, with the side cup panels, will be formed with the width of the tubes of nylon, roughly three and one-half to four inches tall, and the height (from strap segments to top of the waist band 20) should be about nine inches. The waist band should be about 25 inches in unstretched dimension. The waist band's front and middle section, which is not secured to the bottoms of the cup panels, is about three-quarters of an inch to an inch between the cups. The several pieces of the invention, at least the waist band and the combination breast support cup panels and segments of the halter straps, are sewn together by any means known and used in the industry. Other aspects of the invention including the cups, bands, and neck elastic may also include a silicone strip for securing the bra. The sides of the cups and the front center portions may have support knitting weaved in to the fabric to increase the strength of the bra and/or to provide decoration in those areas if a manufacturer so chooses.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

What is claimed is:

1. A bra, comprising:

a first front panel configured to support a user's breast;

a first pair of straps integrally formed and extending from the first front panel;

a second front panel configured to support the user's breast;

a second pair of straps integrally formed and extending from the second front panel; and a band configured to encircle the user's abdomen and to which the first front panel, the first pair of straps, the second front panel, and the second pair of straps are affixed, wherein the first front panel and the first pair of straps are formed from a single piece of fabric and wherein the second front panel and the second pair of straps are formed from a single piece of fabric.

2. The bra of claim 1, wherein one or more of the first front panel, the first pair of straps, the second front panel, and the second pair of straps are formed from an elastomeric or mechanical stretch material.

3. The bra of claim 2, wherein the elastomeric or mechanical stretch material is knitted, woven, or non-woven.

4. The bra of claim 2, wherein the elastomeric or mechanical stretch material comprises nylon and an elastomer or a mechanical stretch fabric.

5. The bra of claim 1, wherein one or more of the first front panel, the first pair of straps, the second front panel, and the second pair of straps have a two-layer structure.

6. The bra of claim 1, wherein one or more of the first front panel, the first pair of straps, the second front panel, and the second pair of straps have flat folded seamless edges.

7. The bra of claim 1, further comprising stitching at a central portion of one or more of the first front panel, the first pair of straps, the second front panel, and the second pair of straps.

8. The bra of claim 1, further comprising a support material sewn or integrated into the first pair of straps and/or the second pair of straps.

9. The bra of claim 8, wherein the support material is a stretchable tape, a stabilizer, a fabric through a yarn, or a tensioning element.

10. The bra of claim 1, wherein the first pair of straps and the second pair of straps are attached at different positions on the band.

11. A garment, comprising:

a first front panel configured to support a user's breast;

a first pair of straps integrally formed and extending from the first front panel;

a second front panel configured to support the user's breast;

a second pair of straps integrally formed and extending from the second front panel; and a band configured to encircle the user's abdomen and to which the first front panel, the first pair of straps, the second front panel, and the second pair of straps are affixed, wherein the first front panel and the first pair of straps are formed from a single piece of fabric and wherein the second front panel and the second pair of straps are formed from a single piece of fabric.

12. The garment of claim 11, wherein one or more of the first front panel, the first pair of straps, the second front panel, and the second pair of straps are formed from an elastomeric or mechanical stretch material.

13. The garment of claim 12, wherein the elastomeric or mechanical stretch material is knitted, woven, or non-woven.

14. The garment of claim 12, wherein the elastomeric or mechanical stretch material comprises nylon and an elastomer or a mechanical stretch fabric.

15. The garment of claim 11, wherein one or more of the first front panel, the first pair of straps, the second front panel, and the second pair of straps have a two-layer structure.

16. The garment of claim 11, wherein one or more of the first front panel, the first pair of straps, the second front panel, and the second pair of straps have flat folded seamless edges.

17. The garment of claim 11, further comprising stitching at a central portion of one or more of the first front panel, the first pair of straps, the second front panel, and the second pair of straps.

18. The garment of claim 11, further comprising a support material sewn or integrated into the first pair of straps and/or the second pair of straps.

19. The garment of claim 11, wherein the first pair of straps and the second pair of straps are attached at different positions on the band.

20. A method of constructing a bra, comprising:

forming a first front panel configured to support a user's breast and a first pair of straps integrally formed and extending from the first front panel;

forming a second front panel configured to support the user's breast and a second pair of straps integrally formed and extending from the second front panel; and affixing the first front panel, the first pair of straps, the second front panel, and the second pair of straps to a band configured to encircle the user's abdomen, wherein the first front panel and the first pair of straps are formed from a single piece of fabric and wherein the second front panel and the second pair of straps are formed from a single piece of fabric.

* * * * *